US009658546B2

(12) United States Patent
Tanaka et al.

(10) Patent No.: US 9,658,546 B2
(45) Date of Patent: May 23, 2017

(54) TONER AND METHOD OF PRODUCING TONER

(71) Applicant: CANON KABUSHIKI KAISHA, Tokyo (JP)

(72) Inventors: Keisuke Tanaka, Yokohama (JP); Takashi Matsui, Mishima (JP); Satoshi Arimura, Mishima (JP); Kozue Uratani, Mishima (JP); Shohei Tsuda, Suntou-gun (JP); Naoki Okamoto, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/943,813

(22) Filed: Nov. 17, 2015

(65) Prior Publication Data

US 2016/0154331 A1 Jun. 2, 2016

(30) Foreign Application Priority Data

Nov. 28, 2014 (JP) ..... 2014-241180
Nov. 9, 2015 (JP) ..... 2015-219304

(51) Int. Cl.
*G03G 9/08* (2006.01)
*G03G 9/097* (2006.01)

(52) U.S. Cl.
CPC ..... *G03G 9/0819* (2013.01); *G03G 9/0802* (2013.01); *G03G 9/0827* (2013.01); *G03G 9/09725* (2013.01)

(58) Field of Classification Search
CPC ..... G03G 9/09725; G03G 9/0819
(Continued)

(56) References Cited

U.S. PATENT DOCUMENTS 7,625,686 B2 * 12/2009 Ohmura ..... G03G 9/0827 430/109.4
8,703,378 B2 4/2014 Satoh et al.
(Continued)

FOREIGN PATENT DOCUMENTS

JP 2005-270955 6/2005
JP 2005-270955 10/2005
(Continued)

OTHER PUBLICATIONS

Tsuda, et al., U.S. Appl. No. 14/892,575, filed Nov. 19, 2015.
Tsuda, et al., U.S. Appl. No. 14/812,793, filed Jul. 29, 2015.
Tsuda, et al., U.S. Appl. No. 14/923,194, filed Oct. 26, 2015.

*Primary Examiner* — Mark A Chapman
(74) *Attorney, Agent, or Firm* — Fitzpatrick Cella Harper and Scinto

(57) ABSTRACT

Provided is toner comprising toner particle containing binder resin and colorant and silica fine particle, wherein: the silica fine particle contains silica fine particle A and silica fine particle B; silica fine particle A has a number average particle diameter of primary particle of 5 nm or more and 20 nm or less; silica fine particle B has a number average particle diameter of primary particle of 80 nm or more and 200 nm or less; and silica fine particle B has a half width of a peak of primary particle of 25 nm or less, in a weight-based particle size distribution, and wherein when the toner is measured by adhesive force-measuring method by using polycarbonate thin film, an adhesion of the silica fine particle A is 0.5% by area or less relative to 100% by area of the total area of the polycarbonate thin film.

11 Claims, 3 Drawing Sheets

(58) Field of Classification Search
USPC ..... 430/108.7
See application file for complete search history.

(56) References Cited

U.S. PATENT DOCUMENTS

| | | | |
|---|---|---|---|
| 8,945,805 | B2 | 2/2015 | Baba et al. |
| 9,005,865 | B2 | 4/2015 | Ikeda et al. |
| 9,213,251 | B2 | 12/2015 | Ohmori et al. |
| 2010/0261109 | A1 | 10/2010 | Okada et al. |
| 2014/0302433 | A1 | 10/2014 | Hasegawa et al. |
| 2014/0377696 | A1 | 12/2014 | Hasegawa et al. |
| 2015/0125790 | A1 | 5/2015 | Hotta et al. |
| 2015/0185643 | A1 | 7/2015 | Magome et al. |
| 2015/0185644 | A1 | 7/2015 | Matsui et al. |
| 2015/0185656 | A1 | 7/2015 | Ito et al. |
| 2015/0185658 | A1 | 7/2015 | Wakabayashi et al. |
| 2015/0227067 | A1 | 8/2015 | Hasegawa et al. |
| 2015/0227068 | A1 | 8/2015 | Sano et al. |

FOREIGN PATENT DOCUMENTS

| | | | |
|---|---|---|---|
| JP | 2007-178623 | A | 7/2007 |
| JP | 2008-145652 | A | 6/2008 |
| JP | 2009-229785 | A | 10/2009 |
| JP | 2011-186402 | A | 9/2011 |
| JP | 2011-197371 | A | 10/2011 |
| JP | 2012-63636 | A | 3/2012 |
| JP | 2012-118511 | A | 6/2012 |
| JP | 2013-152460 | A | 8/2013 |
| JP | 2014-81573 | A | 5/2014 |

* cited by examiner

TONER AND METHOD OF PRODUCING TONER

BACKGROUND OF THE INVENTION

Field of the Invention

The present invention relates to a toner to be used in, for example, an electrophotographic method, an electrostatic recording method, or a magnetic recording method, and a method of producing the toner.

Description of the Related Art

A printer or a copying machine needs to be excellent in reproducibility of a latent image and to have a high resolution. At the same time, the downsizing of a main body of any such apparatus and such stability of an image that the quality of the image does not change even when the apparatus is used for a long time period irrespective of its use environment have been required.

First, an approach to realizing the downsizing of the main body is, for example, the downsizing of a printer constituent member or the elimination of the member. One example of the approach is the compacting of a toner-storing portion, such as a cartridge. A reduction in toner consumption per page has been strongly required for the downsizing of the toner-storing portion. To that end, it is important that a latent image be developed with a just enough amount of a toner. An effective method for the reduction in toner consumption is a one-component contact developing system involving pressing a developer carrying member against the surface of an electrostatic latent image-bearing member (photosensitive member) to perform the development.

In a conventional one-component contact developing system, the developer carrying member and a developer-supplying member are stored in a developing device. The elimination of the developer-supplying member enables not only the reduction in toner consumption but also additional compacting of the toner-storing portion. In addition, the elimination of a cleaning blade, such as an elastic rubber blade, configured to clean out a toner remaining on the photosensitive member without being transferred onto a transfer material after transfer (transfer residual toner) leads to additional compacting of the cartridge.

However, when such developer-supplying member is not used, the stabilization of image quality at the time of long-term use becomes a problem. In particular, a difference between developability after black image output and that after white image output in a low-temperature and low-humidity environment, i.e., a so-called developing ghost is a problem. In addition, there occurs a problem in that the transfer residual toner is continuously sandwiched in a gap between the developer carrying member and the photosensitive member, i.e., a so-called development nip owing to the long-term use to be compressed, thereby melt-adhering onto the photosensitive member (hereinafter referred to as "melt adhesion to the photosensitive member").

In the following documents, various approaches from the toner have been performed for such stabilization of the image quality at the time of the long-term use independent of a use environment.

In Japanese Patent Application Laid-Open No. 2008-145652, there is proposed a toner in which the state of adhesion of hydrophobic silica having an average particle diameter of from 30 nm to 100 nm is controlled by an external addition step.

In Japanese Patent Application Laid-Open No. 2009-229785, there is proposed a toner for developing an electrostatic latent image, having a ratio HH/HL of its saturated water content HH under high-temperature and high-humidity conditions (30° C. and 95% RH) to its saturated water content HL under low-temperature and low-humidity conditions (10° C. and 15% RH) falling within a range of 1.50 or less.

In Japanese Patent Application Laid-Open No. 2012-63636, there is disclosed a method of producing a toner in which the states of adhesion of particles having an average primary particle diameter of 100 nm or more and 1 μm or less are controlled by an external addition apparatus.

In Japanese Patent Application Laid-Open No. 2011-197371, there is proposed a toner in which: an external additive having a particle diameter of less than 100 nm is fixed to the surface of a toner base particle; and an external additive having a particle diameter of 100 nm or more and 500 nm or less is adhered to the surface of the toner base particle so as to be capable of being liberated.

In Japanese Patent Application Laid-Open No. 2014-81573, there is proposed a toner in which the amounts of large-particle diameter hydrophobic silica having a particle diameter of from 80 nm to 500 nm, medium-particle diameter hydrophobic silica having a particle diameter of from 20 nm to 70 nm, and small-particle diameter hydrophobic silica having a particle diameter of from 5 nm to 15 nm to be added to a toner particle containing a bioplastic resin are adjusted.

SUMMARY OF THE INVENTION

As a result of investigations by the inventors of the present invention, it has been found that each of the toners described in the documents tends to be improved in image quality stability at the time of long-term use, but the improvement is still insufficient, and in particular, each of the toners is susceptible to improvement in terms of compatibility between the suppression of the occurrence of a developing ghost in a low-temperature and low-humidity environment, and the suppression of melt adhesion to a photosensitive member at the time of the long-term use.

The present invention is providing a toner that can solve the problems. Specifically, the present invention is providing a toner that provides a stable image density at the time of its long-term use, can suppress the occurrence of a developing ghost in a low-temperature and low-humidity environment, and suppresses a harmful effect, such as its melt adhesion to a photosensitive member.

The inventors of the present invention have found that when a state in which a toner is covered with an external additive is controlled by using a silica fine particle A and a silica fine particle B together with a toner particle, a stable image density is obtained at the time of its long-term use, the occurrence of a developing ghost in a low-temperature and low-humidity environment can be suppressed, and a harmful effect, such as its melt adhesion to a photosensitive member, can be suppressed. Thus, the inventors have reached the present invention.

The present invention is as described below.

According to one aspect of the present invention, there is provided a toner, comprising:

a toner particle containing a binder resin and a colorant; and a silica fine particle, wherein:

the silica fine particle contains a silica fine particle A and a silica fine particle B;

the silica fine particle A has a number average particle diameter (D1) of primary particle of 5 nm or more and 20 nm or less;

the silica fine particle B has a number average particle diameter (D1) of primary particle of 80 nm or more and 200 nm or less; and the silica fine particle B has a half width of a peak of primary particle of 25 nm or less, in a weight-based particle size distribution, and wherein when the toner is measured by an adhesive force-measuring method by using a polycarbonate thin film, an adhesion of the silica fine particle A is 0.5% by area or less relative to 100% by area of the total area of the polycarbonate thin film.

According to another aspect of the present invention, there is provided a method of producing a toner, the method including:

a step 1 of externally adding a silica fine particle B to a toner particle containing a binder resin and a colorant; and a step 2 of externally adding a silica fine particle A to the toner, the silica fine particle A having a number average particle diameter (D1) of primary particle of 5 nm or more and 20 nm or less, the silica fine particle B having a number average particle diameter (D1) of primary particle of 80 nm or more and 200 nm or less, the silica fine particle B having a half width of a peak of primary particle of 25 nm or less, in a weight-based particle size distribution, the step 2 including a step of loading the product obtained in the step 1 and the silica fine particle A into a container of a mixing treatment apparatus, followed by treatment, the mixing treatment apparatus including a stirring member having a rotary shaft and a plurality of stirring blades arranged on a surface of the rotary shaft, a container having a cylindrical inner peripheral surface in which the stirring member is stored, and a driver section configured to apply a rotary driving force to the rotary shaft to rotate the stirring member in the container, the plurality of stirring blades being each arranged to have a gap between the stirring blade and the inner peripheral surface of the container, the plurality of stirring blades including a first stirring blade configured to feed a mixing-treated product loaded into the container toward one orientation in an axial direction of the rotary shaft through rotation of the stirring member, and a second stirring blade configured to feed the mixing-treated product toward another orientation in the axial direction of the rotary shaft through the rotation.

Further features of the present invention will become apparent from the following description of exemplary embodiments with reference to the attached drawings.

DESCRIPTION OF THE EMBODIMENTS

Figure 1:
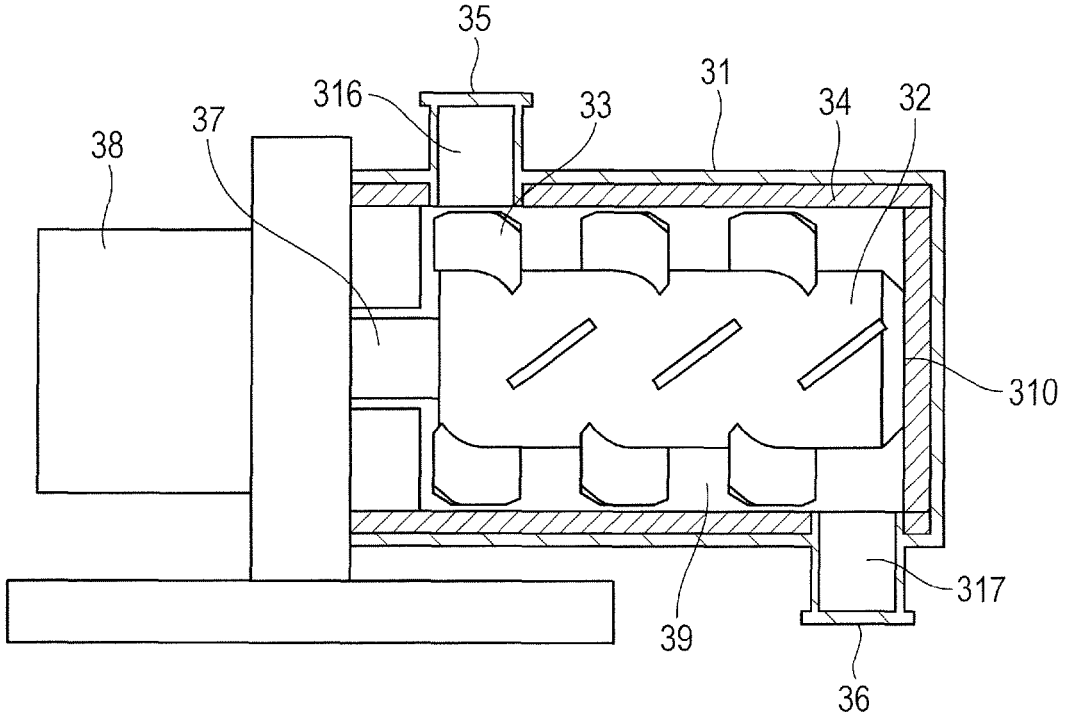
FIG. 1 is a schematic view for illustrating an example of a mixing treatment apparatus that can be used in the external addition and mixing of inorganic fine particles.

A toner of the present invention is described in detail below.

The toner of the present invention includes a toner particle containing a binder resin and a colorant, and a silica fine particle, and has the following characteristics. The silica fine particle contains a silica fine particle A and a silica fine particle B, the silica fine particle A has a number average particle diameter (D1) of primary particle of 5 nm or more and 20 nm or less, and the silica fine particle B has a number average particle diameter (D1) of primary particle of 80 nm or more and 200 nm or less. In addition, the silica fine particle B has a half width of a peak of primary particle of 25 nm or less, in a weight-based particle size distribution. Further, when the toner is measured by an adhesive force-measuring method by using a polycarbonate thin film, an adhesion of the silica fine particle A is 0.5% by area or less relative to 100% by area of the total area of the polycarbonate thin film.

According to investigations by the inventors of the present invention, the use of such toner as described above provides a stable image density at the time of its long-term use, suppresses the occurrence of a developing ghost in a low-temperature and low-humidity environment, and can suppress its melt adhesion to a photosensitive member.

First, a cause for the occurrence of the melt adhesion to the photosensitive member is considered. The melt adhesion to the photosensitive member is a phenomenon in which a toner that has not been transferred from the photosensitive member onto a transfer material is compressed in a contact developing region (hereinafter referred to as "development nip") to melt-adhere to the photosensitive member. In particular, an external additive, such as silica, generally incorporated into the toner is liable to adhere as the product melt-adhering to the photosensitive member, and the silica serves as a starting point to cause the melt adhesion to the photosensitive member. In particular, in an environment in which the toner or the external additive absorbs moisture to increase its adhesive force to any other member, such as a high-temperature and high-humidity environment, the toner is liable to adhere to the photosensitive member and hence the melt adhesion to the photosensitive member tends to be liable to occur.

In order that the occurrence of the melt adhesion to the photosensitive member may be suppressed, the external additive, such as silica fine particles, which is liable to serve as a starting point for the melt adhesion to the photosensitive member, needs to be uniformly and firmly stuck to a toner particle. This is because the external additive, such as the silica fine particles, migrates from the toner particle owing to, for example, long-term use of the toner and the toner is compressed in the development nip to cause the melt adhesion to the photosensitive member. However, when the silica fine particle is too firmly stuck to the toner particle, the silica fine particle is embedded in the toner particle and hence the flowability of the toner tends to be insufficient. A possible cause for the deterioration of the flowability is as follows: the embedment of the silica fine particle in the toner particle reduces the amount of the silica fine particle covering the toner, and hence an action which the silica fine particle exhibits as spacer particle between the toner particles becomes small. An image harmful effect, such as a developing ghost, tends to be liable to occur owing to the deterioration of the flowability of the toner.

The developing ghost is an image harmful effect in which a difference occurs between the toner laid-on level of a non-image region on a developer carrying member and the toner laid-on level of an image region thereon, and hence a density difference appears in, for example, a halftone image.

On the developer carrying member in the image region, when the flowability of the toner is insufficient, it becomes difficult to sufficiently supply the toner to a gap between the developer carrying member and a regulating member, i.e., the so-called regulating member nip, and hence the toner laid-on level tends to be small. On the other hand, the toner continues to be present on the developer carrying member in the non-image region, and hence the toner is liable to be overcharged by the regulating member and the flow of the toner in the regulating member nip is liable to be insufficient. As a result, charging unevenness between the toner particles is liable to occur, it becomes difficult to regulate the toner laid-on level with the regulating member, and hence the toner laid-on level tends to be larger than a desired amount.

The developing ghost tends to be liable to occur under low-temperature and low-humidity conditions, or when the toner is used for a long time period. This is because in a low-temperature and low-humidity environment, the toner is liable to be triboelectrically charged by, for example, a stirring blade in a toner container, and hence a reduction in its flowability due to, for example, the electrostatic agglomeration of the toner particles is liable to occur. That is also because at the time of the long-term use, the embedment of the external additive, such as the silica particles, in the toner particle by, for example, a pressing force between the photosensitive member and the developer carrying member is accelerated, and hence the reduction in flowability is liable to occur.

Summarizing the foregoing, in order that compatibility between the suppression of the occurrence of the melt adhesion to the photosensitive member and the suppression of the occurrence of the developing ghost may be achieved, as described in the foregoing, it is important to control the state of presence of the external additive, such as the silica fine particles, on the surface of the toner particle while securing the flowability of the toner even in the low-temperature and low-humidity environment, or even at the time of the long-term use.

In view of the foregoing, the inventors of the present invention have made extensive investigations for alleviating the developing ghost and suppressing the occurrence of the melt adhesion to the photosensitive member even when the toner is used over a long time period in a low-temperature and low-humidity environment.

The toner of the present invention contains, as the silica fine particle, the silica fine particle A having a number average particle diameter (D1) of primary particle of 5 nm or more and 20 nm or less, and the silica fine particle B having a number average particle diameter (D1) of primary particle of 80 nm or more and 200 nm or less.

When the D1 of the silica fine particle A falls within the above-mentioned range, flowability can be imparted to the toner and hence the charging of the toner can be uniformized. When the D1 of the silica fine particle A is less than 5 nm, the toner is liable to be overcharged and hence the flowability of the toner in the regulating member nip is liable to be insufficient. In addition, the silica fine particle is liable to be embedded in the surface of the toner particle owing to the long-term use, which is also liable to be responsible for the insufficient flowability of the toner in the regulating member nip. When the D1 of the silica fine particle A is more than 20 nm, the chargeability of the toner is liable to be insufficient and hence a desired image density cannot be obtained in some cases.

When the D1 of the silica fine particle B falls within the above-mentioned range, the silica fine particle sufficiently exhibits its function as spacer particle, and hence can suppresses the deterioration of the toner in the development nip or the regulating member nip. When the D1 of the silica fine particle B is less than 80 nm, a spacer effect becomes insufficient and hence the flowability of the toner is liable to be insufficient owing to the long-term use. When the D1 of the silica fine particle B is more than 200 nm, the desorption of the silica fine particle from the surface of the toner is liable to occur, which is also liable to be responsible for the insufficient spacer effect.

Further, in the toner of the present invention, it is important that a half width of a peak of primary particle in a weight-based particle size distribution of the silica fine particle B be 25 nm or less.

The inventors of the present invention have found that the problems can be solved by: setting a half width of a peak of primary particle in a weight-based particle size distribution of the silica fine particle B to 25 nm or less; and controlling the manner in which the silica fine particle A and the silica fine particle B are adhered to the surface of the toner particle (extent of adhesion).

When the toner of the present invention uses the two kinds of silica fine particles and the manner in which the silica fine particles are adhered to the surface of the toner particle is controlled, the adhesion of the silica fine particle A when the toner is measured by an adhesive force-measuring method by using a polycarbonate thin film can be set to 0.5% by area or less relative to 100% by area of the total area of the polycarbonate thin film.

The adhesive force-measuring method by using a polycarbonate thin film is an analysis approach involving: turning a polycarbonate that has heretofore been typically used as a photosensitive member surface layer material into a thin film; uniformly mounting the toner on the thin film; blowing off the toner with air; observing the external additive, such as the silica fine particles, remaining on the polycarbonate thin film; and quantifying the amount and shape of the external additive. Details about the adhesive force-measuring method by using a polycarbonate thin film are described later.

In the adhesive force measurement by using the polycarbonate thin film, a migration property when the silica fine particle present on the surface of the toner particle is forcedly migrated from the toner can be quantified. One of its characteristics lies in that the sizes and shapes of the silica fine particle that has migrated from the toner particle can be grasped because the silica fine particle that has migrated from the toner particle is observed with a scanning electron microscope (SEM).

In addition, an approach involving loading the toner into, for example, an aqueous solution of a surfactant, stirring and shaking the mixture, and separating the silica fine particle from the toner by, for example, a centrifugal separation method (hereinafter referred to as "wet method") is generally available as an approach to measuring the migration property of the silica fine particle from the toner particle.

The adhesive force-measuring method by using a polycarbonate thin film represents the ease with which the silica fine particle migrates to the polycarbonate thin film by migrating the silica fine particle from the toner particle without applying any strong shear to the toner unlike the wet method. The ease of migration represents the sticking strength of the silica fine particle to the toner particle. In other words, in the present invention, the amount of the silica fine particle A adhering to the polycarbonate thin film represents the strength of the sticking of the silica fine particle A to the toner particle and the ease with which the silica fine particle migrates to a member in contact with the toner (especially the photosensitive member), the ease being obtained from the strength of the sticking.

An adhesion of the silica fine particle A adhering to the polycarbonate thin film of 0.5% by area or less means that the silica fine particle A is firmly stuck to the toner particle. The foregoing means that the adhesion of the silica fine particle A to the photosensitive member that may be responsible for the melt adhesion to the photosensitive member is suppressed, and the silica fine particle A uniformly covers, and is stuck to, the toner particle.

By virtue of the state of adhesion of the silica fine particle A, the toner can easily obtain flowability in the regulating member nip, and hence compatibility between the suppression of the developing ghost in a low-temperature and low-humidity environment, and the suppression of the melt adhesion to the photosensitive member can be achieved. When the adhesion of the silica fine particle A in the adhesive force-measuring method by using a polycarbonate thin film is more than 0.5% by area, the sticking strength of the silica fine particle A to the toner particle is small and hence the silica fine particle A is liable to migrate to the photosensitive member. Accordingly, the melt adhesion to the photosensitive member is liable to occur. In addition, a state in which the silica fine particle A is liable to adhere to the polycarbonate thin film means that the toner particle is not uniformly covered with the silica fine particles A, and hence the flowability of the toner is hardly obtained and the developing ghost is liable to worsen.

In order that the adhesion of the silica fine particle A to the polycarbonate thin film may be controlled, first, it is important that the half width of the peak of primary particle in the weight-based particle size distribution of the silica fine particle B be 25 nm or less. When the half width of silica fine particle B is 25 nm or less, uniform dispersion of the silica fine particle A in the toner particle and uniform sticking of the silica fine particle A to the toner particle can be achieved at high levels. When the half width of the silica fine particle B is more than 25 nm, the dispersibility and sticking property of the silica fine particle A are liable to be insufficient, their adhesion to the polycarbonate thin film increases, and hence the melt adhesion to the photosensitive member or the developing ghost is liable to occur in some cases.

In addition, the adhesion of the silica fine particle A to the polycarbonate thin film can be controlled by adjusting, for example, an apparatus for externally adding the silica fine particle A, the order in which the silica fine particle A and the silica fine particle B are externally added, an external addition strength, and an external addition time.

In particular, the order in which the silica fine particle A and the silica fine particle B are externally added is preferably as follows: first, the toner particle and the silica fine particle B are externally added, and then the silica fine particle A are externally added. The inventors of the present invention have assumed the reason why the external addition in such order is preferred to be as described below.

First, silica fine particles having a narrow half width of a peak of primary particles in a weight-based particle size distribution, i.e., having a narrow particle size distribution are externally added to the toner particle, whereby high flowability can be easily obtained as compared with the case where silica fine particles having a wide particle size distribution are externally added. The inventors of the present invention have considered a reason for the foregoing to be as described below. When the particle size distribution of the silica fine particles sticking to the toner particle is narrow, i.e., the silica fine particles have a uniform particle diameter, the collision of the silica fine particles with the toner particle is evenly performed at the time of the external addition, and hence the toner particle can be uniformly covered with the silica fine particles with ease and the high flowability can be easily obtained. In particular, silica fine particles having large particle diameters tend to hardly loosen, and hence it tends to be difficult to uniformly cover the toner particle with the silica fine particles. Therefore, it is important to adjust a particle diameter and a particle size distribution like the silica fine particles B, and to adjust external addition conditions, such as the external addition strength and the external addition time.

Next, the silica fine particles A are externally added to the toner particle having externally added thereto the silica fine particles B and improved in flowability, whereby the silica fine particles A properly loosen, and are uniformly and firmly stuck to the toner particle. The inventors of the present invention have considered that when the external addition is performed under such conditions, such toner that the adhesion of the silica fine particle A in the adhesive force-measuring method by using the polycarbonate thin film becomes 0.5% by area or less can be easily obtained, and hence the suppression of the melt adhesion to the photosensitive member and the developing ghost is achieved.

In the present invention, both dry silica produced by, for example, the vapor phase oxidation of a silicon halide, i.e., so-called dry method silica or fumed silica, and so-called wet silica produced from, for example, water glass can each be used as a base material silica of the silica fine particle A.

The silica fine particle A to be used in the present invention is preferably subjected to hydrophobic treatment with at least one of an alkoxysilane and/or a silazane, or a silicone oil. That is, the silica fine particle A preferably has, on its surface, a structure derived from at least one compound selected from the alkoxysilane and/or the silazane, and the silicone oil. The silica fine particle A may be subjected to hydrophobic treatment with one kind of the alkoxysilane and/or the silazane, and the silicone oil, or may be treated with both the compounds. When the silica fine particle is treated with both the compounds, the base material silica can be subjected to hydrophobic treatment reactions with the alkoxysilane and/or the silazane, and with the silicone oil. The reaction with the alkoxysilane and/or the silazane may be performed prior to the reaction with the silicone oil, and vice versa.

The silica fine particle A to be used in the present invention may be subjected to shredding treatment during the treatment step or after the treatment step. Further, when the silica fine particle is treated in two stages, the shredding treatment can be performed between the treatments.

From the viewpoint of the suppression of a reduction in chargeability in a high-temperature and high-humidity environment, the extent to which the silica fine particle A to be used in the present invention are subjected to the hydrophobic treatment is as follows: a hydrophobic ratio to be described later is preferably 70% or more and 100% or less, more preferably 80% or more and 100% or less.

In addition, the silica fine particle A to be used in the present invention is desirably subjected to surface treatment (hydrophobic treatment) with 5.0 parts by mass or more and 40.0 parts by mass or less of the silicone oil with respect to 100 parts by mass of the base material silica. Examples of the silicone oil include a dimethylsilicone oil, a methylphenylsilicone oil, an α-methylstyrene-modified silicone oil, a chlorophenylsilicone oil, and a fluorine-modified silicone oil. The hydrophobic ratio of the silica fine particle can be adjusted by increasing or reducing the amount of the silicone oil in the treatment.

In the present invention, the silicone oil to be used in the treatment of the silica fine particle A preferably has a kinematic viscosity at 25° C. of 30 cSt or more and 500 cSt or less. When the kinematic viscosity falls within the above-mentioned range, the kinematic viscosity can be uniformly controlled with ease upon hydrophobic treatment of the base material silica with the silicone oil. Further, the kinematic viscosity of the silicone oil is germane to the molecular chain length of the silicone oil, and the case where the kinematic viscosity falls within the above-mentioned range is preferred because the degree of agglomeration of the silica fine particles A can be easily controlled to a suitable range. The kinematic viscosity of the silicone oil at 25° C. more preferably falls within the range of from 40 cSt or more to 300 cSt or less. An apparatus for measuring the kinematic viscosity of the silicone oil is, for example, a capillary kinematic viscometer (manufactured by Kaburagi Kagaku Kikai Kogyo) or a fully automatic trace amount kinematic viscometer (manufactured by Viscotech Co., Ltd.).

The silica fine particle A to be used in the present invention is preferably obtained by treating the base material silica with the silicone oil, and then treating the base material silica with at least one of the alkoxysilane or the silazane. The remaining untreated surface of the base material silica can be subjected to hydrophobic treatment by the treatment with at least one of the alkoxysilane or the silazane, and hence silica fine particle having a high hydrophobic ratio can be stably obtained. Further, the treatments are preferably performed in the foregoing order because the ease with which the toner loosens can be significantly improved. The inventors of the present invention have considered the reason why the ease of loosening can be improved to be as described below. Only one terminal of the molecular terminals of the silicone oil on the surface of the silica fine particle A has a degree of freedom, and affects the property by which the silica fine particles A agglomerate. On the other hand, when such two-stage treatment as described above is performed, nearly no molecular terminals of the silicone oil are present on the outermost surface of each of the silica fine particle A, and hence the property by which the silica fine particles A agglomerate can be additionally reduced. Thus, the property by which the toner particles agglomerate upon external addition can be significantly reduced, and hence the ease with which the toner loosens can be improved.

The surface treatment of the base material silica with the silicone oil, and the surface treatment thereof with the alkoxysilane and/or the silazane may each be dry treatment or wet treatment. A specific procedure for the surface treatment of the base material silica with the silicone oil is, for example, as follows: the silica fine particles are loaded into a solvent having dissolved therein the silicone oil (the pH of the solvent is preferably adjusted to 4 with an organic acid or the like) to be subjected to a reaction, and then the solvent is removed.

A specific procedure in the case where the surface treatment with at least one of the alkoxysilane or the silazane is subsequently performed is, for example, the following method. The silicone oil-treated silica fine particles that have been shredded are loaded into a solvent having dissolved therein at least one of the alkoxysilane or the silazane to be subjected to a reaction, and then the solvent is removed, followed by shredding treatment.

Such method as described below is also permitted. For example, in the surface treatment with the silicone oil, the silica fine particles are loaded into a reaction vessel. Then, under a nitrogen atmosphere, alcohol water is added to the reaction vessel while the silica fine particles are stirred, and the silicone oil is introduced into the reaction vessel to perform the surface treatment. Further, the solvent is removed by heating and stirring the mixture, and the residue is subjected to shredding treatment. In the surface treatment with at least one of the alkoxysilane or the silazane, under a nitrogen atmosphere, while the silica fine particles are stirred, at least one of the alkoxysilane or the silazane is introduced to perform the surface treatment, and the solvent is removed by heating and stirring the mixture, followed by cooling. Suitable examples of the alkoxysilane can include methyltrimethoxysilane, dimethyldimethoxysilane, phenyltrimethoxysilane, methyltriethoxysilane, dimethyldiethoxysilane, and phenyltriethoxysilane. On the other hand, a suitable example of the silazane may be hexamethyldisilazane. The amount of at least one of the alkoxysilane or the silazane to be used in the treatment is as follows: the total amount of at least one of the alkoxysilane or the silazane is 0.1 part by mass or more and 20.0 parts by mass or less with respect to 100 parts by mass of the base material silica.

The silica fine particle A has a carbon amount-based fixation ratio of the silicone oil of preferably 70 mass % or more and 100 mass % or less, more preferably 80 mass % or more and 100 mass % or less, still more preferably 90 mass % or more and 100 mass % or less. The case where the fixation ratio falls within the above-mentioned range is preferred because of the following reason: the agglomeration of the silica fine particles A is suppressed, and hence the adhesion of the silica fine particles A in the adhesive force-measuring method by using the polycarbonate thin film can be easily controlled. The carbon amount-based fixation ratio of the silicone oil can be controlled by treating the silica fine particles A with at least one of the alkoxysilane or the silazane after treating the silica fine particles with the silicone oil.

The addition amount of the silica fine particles A is preferably 0.5 parts by mass or more and 1.5 parts by mass or less with respect to 100 parts by mass of the toner particle. When the addition amount of the silica fine particles A is 0.5 parts by mass or more, the toner particle can be uniformly covered with the silica fine particles A with ease, and hence flowability can be easily obtained. An addition amount of the silica fine particles A of 1.5 parts by mass or less is preferred because the adhesion of the silica fine particle A in the adhesive force-measuring method by using the polycarbonate thin film can be easily controlled.

In order that the carbon amount-based fixation ratio of the silicone oil in the silica fine particle A may be increased, the silicone oil needs to be chemically fixed to the surface of the base material silica in the process of obtaining the silica fine particle A. To that end, a method involving performing heating treatment for a reaction of the silicone oil in the process of obtaining the silica fine particle A can be suitably given. A heating treatment temperature is preferably 100° C. or more, and as the heating treatment temperature increases, the fixation ratio can be increased. The heating treatment step is preferably performed immediately after the silicone oil treatment has been performed. However, when shredding treatment is performed, the heating treatment step may be performed after the shredding treatment step.

The silica fine particle A to be used in the present invention may be subjected to shredding treatment during the treatment step or after the treatment step. Further, when the silica fine particle is treated in two stages, the shredding treatment can be performed between the treatments.

In the present invention, both dry silica produced by, for example, the vapor phase oxidation of a silicon halide, i.e., so-called dry method silica or fumed silica, and so-called wet silica produced from, for example, water glass can each be used as a base material silica of the silica fine particle B.

In the present invention, the silica fine particle B is preferably silica fine particle produced by a sol-gel method. The sol-gel method is a method involving: subjecting an alkoxysilane to hydrolysis and a condensation reaction in an organic solvent in which water is present with a catalyst to provide a silica sol suspension; removing the solvent from the suspension; and drying the residue to turn the residue into particles. The silica fine particles obtained by the sol-gel method have moderate particle diameters and a moderate particle size distribution, and are monodisperse and spherical. Accordingly, the silica fine particles can be uniformly dispersed in the surface of the toner particle with ease, and can reduce the physical adhesive force of the toner by virtue of their stable spacer effect.

The silica fine particles based on the sol-gel method are produced as described below. First, the alkoxysilane is subjected to hydrolysis and a condensation reaction in the organic solvent in which water is present with the catalyst to provide the silica sol suspension. Then, the solvent is removed from the silica sol suspension, and the residue is dried to provide the silica fine particles. The number average particle diameter of primary particle of the silica fine particle based on the sol-gel method can be controlled by a reaction temperature in the hydrolysis-condensation reaction step, the dropping rate of the alkoxysilane, a weight ratio among water, the organic solvent, and the catalyst, and a stirring speed. For example, as the reaction temperature increases, the number average particle diameter of primary particle of the silica fine particle tends to reduce.

The silica fine particles thus obtained are typically hydrophilic and have many surface silanol groups. Accordingly, when the silica fine particles are used as an external additive of the toner, the surfaces of the silica fine particles are preferably subjected to hydrophobic treatment.

A method for the hydrophobic treatment is, for example, a method involving removing the solvent from the silica sol suspension, drying the residue, and then treating the dried product with a hydrophobic treatment agent, or a method involving directly adding the hydrophobic treatment agent to the silica sol suspension to treat the silica fine particles simultaneously with drying. The approach involving directly adding the hydrophobic treatment agent to the silica sol suspension is preferred from the viewpoints of the control of the half width in the weight-based particle size distribution of primary particle of the silica fine particle B and the control of the saturated moisture adsorption amount of the silica fine particles. The hydrophobic treatment in the suspension inhibits the occurrence of an agglomerate after the drying and enables uniform coating because the silica fine particles can be subjected to the hydrophobic treatment under a state in which sol-gel silica is present in a monodisperse manner.

In addition, the pH of the silica sol suspension is more preferably acidic. The acidification of the suspension improves its reactivity with the hydrophobic treatment agent, and hence enables the performance of additionally strong and uniform hydrophobic treatment.

Examples of the hydrophobic treatment agent include γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)-γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, p-methylphenyltrimethoxysilane, methyltriethoxysilane, butyltriethoxysilane, hexyltriethoxysilane, octyltriethoxysilane, decyltriethoxysilane, dodecyltriethoxysilane, phenyltriethoxysilane, o-methylphenyltriethoxysilane, and p-methylphenyltriethoxysilane.

Further, the silica fine particles may be subjected to shredding treatment in order that the silica fine particles may be easily monodispersed in the surface of the toner particle or may be caused to exhibit a stable spacer effect.

The apparent density of the silica fine particle A to be used in the present invention is preferably 15 g/L or more and 50 g/L or less. In addition, the apparent density of the silica fine particle B to be used in the present invention is preferably 150 g/L or more and 300 g/L or less. A state in which the apparent density of the silica fine particle B falls within the above-mentioned range means that the silica fine particles A hardly pack in a dense manner and are present while a large amount of air is interposed between the fine particles, and hence their apparent density is extremely low. Accordingly, the property by which the toner particle and the silica fine particles B mix with each other improves at the time of an external addition step, and hence a uniform covered state can be easily obtained. In addition, when the average circularity of the toner particle is higher, the phenomenon is more significant and hence a more uniform covered state can be easily obtained. As a result, the externally added toner particles hardly pack in a dense manner, and hence an adhesive force between the toner particles can easily reduce and the flowability of the toner improves. Accordingly, the developing ghost can be easily alleviated.

Examples of a method of controlling the apparent density of the silica fine particle B to the above-mentioned range include: the hydrophobic treatment in the silica sol suspension; the regulation of the strength of the shredding treatment after the hydrophobic treatment; and the adjustment of the amount of the hydrophobic treatment agent. The performance of the uniform hydrophobic treatment can reduce the amount of a relatively large agglomerate itself. Alternatively, the regulation of the strength of the shredding treatment can loosen a relatively large agglomerate in the silica fine particles after the drying into relatively small secondary particles, and hence can reduce the apparent density.

The addition amount of the silica fine particles B is preferably 0.1 part by mass or more and 1.0 part by mass or less, more preferably 0.1 part by mass or more and 0.5 part by mass or less with respect to 100 parts by mass of the toner particle. The case where the addition amount of the silica fine particles B falls within the above-mentioned range is preferred because a spacer effect can be easily obtained, the adhesion of the silica fine particle A in the adhesive force-measuring method by using the polycarbonate thin film can be easily controlled, and fixation inhibition is reduced.

The toner particle of the present invention contains the binder resin. Examples of the binder resin include a vinyl resin, a polyester resin, an epoxy resin, and a polyurethane resin. Those conventionally known resins can each be used without any particular limitation. Of those, a polyester resin or a vinyl resin is preferably incorporated from the viewpoint of compatibility between the chargeability and fixability.

An alcohol component and an acid component that can be used in the synthesis of the polyester resin are as described below.

As a dihydric alcohol component, there are given: ethylene glycol, propylene glycol, 1,3-butanediol, 1,4-butanediol, 2,3-butanediol, diethylene glycol, triethylene glycol, 1,5-pentanediol, 1,6-hexanediol, 1,9-nonanediol, neopentyl glycol, 2-ethyl-1,3-hexanediol, hydrogenated bisphenol A, a bisphenol represented by the formula (A) and a derivative thereof:

(A)

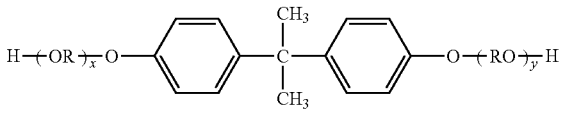

(in the formula, R represents an ethylene or propylene group, x and y each represent an integer of 0 or more, and the average of x+y is from 0 to 10), and diols each represented by the formula (B):

(B)

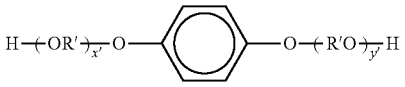

(in the formula, R' represents —$CH_2CH_2$—,

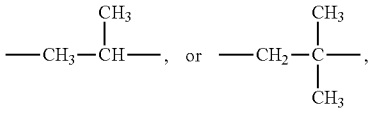

X' and Y' each represent an integer of 0 or more, and the average of X'+Y' is from 0 to 10).

As a divalent acid component, for example, there are given dicarboxylic acids and derivatives thereof, such as: benzene dicarboxylic acids, such as phthalic acid, terephthalic acid, isophthalic acid, and phthalic anhydride, or anhydrides or lower alkyl esters thereof; alkyldicarboxylic acids, such as succinic acid, adipic acid, sebacic acid, and azelaic acid, or anhydrides or lower alkyl esters thereof; alkenylsuccinic acids or alkylsuccinic acids, such as n-dodecenylsuccinic acid and n-dodecylsuccinic acid, or anhydrides or lower alkyl esters thereof; and unsaturated dicarboxylic acids, such as fumaric acid, maleic acid, citraconic acid, and itaconic acid, or anhydrides or lower alkyl esters thereof.

In addition, an alcohol component that is trihydric or more and an acid component that is trivalent or more, the components serving as crosslinking components, may be used in combination.

As a polyhydric alcohol component that is trihydric or more, for example, there are given sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene.

In addition, as a polyvalent carboxylic acid component that is trivalent or more in the present invention, for example, there are given polyvalent carboxylic acids and derivatives thereof such as: trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, and an enpol trimer acid, and anhydrides and lower alkyl esters thereof; and tetracarboxylic acids each represented by the following formula and anhydrides and lower alkyl esters thereof:

(C)

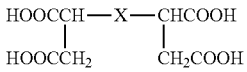

(in the formula, X represents an alkylene or alkenylene group having 5 to 30 carbon atoms and having one or more sides chains each having 3 or more carbon atoms).

The content of the alcohol component is generally from 40 mol % to 60 mol %, preferably from 45 mol % to 55 mol %. In addition, the content of the acid component is generally from 60 mol % to 40 mol %, preferably from 55 mol % to 45 mol %.

The polyester resin is typically obtained by generally known condensation polymerization.

In addition, a vinyl resin is also preferably used for the binder resin.

For example, the following monomers are given as polymerizable monomers (vinyl monomers) for producing the vinyl resin.

For example, there are given: styrene; derivatives of styrene, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; unsaturated monoolefins, such as ethylene, propylene, butylene, and isobutylene; unsaturated polyenes, such as butadiene and isoprene; vinyl halides, such as vinyl chloride, vinylidene chloride, vinyl bromide, and vinyl fluoride; vinyl esters, such as vinyl acetate, vinyl propionate, and vinyl benzoate; α-methylene aliphatic monocarboxylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinylpyrrolidone; vinylnaphthalenes;

and acrylic acid or methacrylic acid derivatives, such as acrylonitrile, methacrylonitrile, and acrylamide.

Further, there are given: unsaturated dibasic acids, such as maleic acid, citraconic acid, itaconic acid, an alkenylsuccinic acid, fumaric acid, and mesaconic acid; unsaturated dibasic acid anhydrides, such as maleic anhydride, citraconic anhydride, itaconic anhydride, and an alkenylsuccinic anhydride; unsaturated dibasic acid half esters, such as a methyl maleate half ester, an ethyl maleate half ester, a butyl maleate half ester, a methyl citraconate half ester, an ethyl citraconate half ester, a butyl citraconate half ester, a methyl itaconate half ester, a methyl alkenylsuccinate half ester, a methyl fumarate half ester, and a methyl mesaconate half ester; unsaturated dibasic acid esters, such as dimethyl maleate and dimethyl fumarate; α,β-unsaturated acids, such as acrylic acid, methacrylic acid, crotonic acid, and cinnamic acid; α,β-unsaturated acid anhydrides, such as crotonic anhydride and cinnamic anhydride, and anhydrides of the α,β-unsaturated acids and lower fatty acids; and monomers each having a carboxyl group, such as an alkenylmalonic acid, an alkenylglutaric acid, and an alkenyladipic acid, and acid anhydrides thereof and monoesters thereof.

Further, there are given: acrylic acid esters and mathacrylic acid esters, such as 2-hydroxyethyl acrylate, 2-hydroxyethyl methacrylate, and 2-hydroxypropyl methacrylate; and monomers each having a hydroxy group, such as 4-(1-hydroxy-1-methylbutyl)styrene and 4-(1-hydroxy-1-methylhexyl)styrene.

In the toner of the present invention, the vinyl resin serving as the binder resin may have a crosslinked structure crosslinked with a crosslinking agent having two or more vinyl groups. In this case, for example, the following crosslinking agents are used. As aromatic divinyl compounds, there are given, for example, divinylbenzene and divinylnaphthalene. As diacrylate compounds bonded by alkyl chains, there are given, for example, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and those obtained by changing the acrylates of the above-mentioned compounds to methacrylates. As diacrylate compounds bonded by alkyl chains each containing an ether bond, there are given, for example, diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and those obtained by changing the acrylates of the above-mentioned compounds to methacrylates. As diacrylate compounds bonded by chains each containing an aromatic group and an ether bond, there are given, for example, polyoxyethylene(2)-2,2-bis(4-hydroxyphenyl)propane diacrylate, polyoxyethylene(4)-2,2-bis(4-hydroxyphenyl)propane diacrylate, and those obtained by changing the acrylates of the above-mentioned compounds to methacrylates. As a polyester-type diacrylate compound, there is given, for example, a product available under the trade name MANDA (Nippon Kayaku Co., Ltd.).

As polyfunctional crosslinking agents, there are given: pentaerythritol triacrylate, trimethylolethane triacrylate, trimethylolpropane triacrylate, tetramethylolmethane tetraacrylate, oligoester acrylate, and those obtained by changing the acrylates of the above-mentioned compounds to methacrylates; and triallyl cyanurate and triallyl trimellitate.

Those crosslinking agents can each be typically used in an amount of from 0.01 part by mass to 10 parts by mass (preferably from 0.03 part by mass to 5 parts by mass) with respect to 100 parts by mass of the monomer component except the crosslinking agent.

Of those crosslinkable monomers, aromatic divinyl compounds (in particular, divinylbenzene) and diacrylate compounds bonded by chains each containing an aromatic group and an ether bond are given as ones to be suitably used for the binder resin from the viewpoints of fixability and offset resistance.

As a polymerization initiator to be used in the case of producing the vinyl resin as the binder resin, there are given, for example, 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2-azobis(2-methylpropane), ketone peroxides, such as methyl ethyl ketone peroxide, acetylacetone peroxide, and cyclohexanone peroxide, 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, dicumyl peroxide, α,α'-bis(t-butylperoxyisopropyl) benzene, isobutyl peroxide, octanoyl peroxide, decanoyl peroxide, lauroyl peroxide, 3,5,5-trimethylhexanoyl peroxide, benzoyl peroxide, m-toluoyl peroxide, di-isopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl)peroxycarbonate, acetyl cyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydroterephthalate, and di-t-butyl peroxyazelate.

The binder resin according to the present invention preferably has a glass transition temperature (Tg) of generally 45° C. or more and 70° C. or less, preferably 50° C. or more and 70° C. or less from the viewpoint of achieving both low-temperature fixability and storage stability.

The toner particle of the present invention contains a colorant. For examples, the following colorants are given as a colorant preferably used in the present invention.

As an organic pigment or an organic dye serving as a cyan colorant, there are given a copper phthalocyanine compound and a derivative thereof, an anthraquinone compound, and a basic dye lake compound.

As an organic pigment or an organic dye serving as a magenta colorant, there are given a condensed azo compound, a diketopyrrolopyrrole compound, anthraquinone, a quinacridone compound, a basic dye lake compound, a naphthol compound, a benzimidazolone compound, a thioindigo compound, and a perylene compound.

As an organic pigment or an organic dye serving as a yellow colorant, there are given compounds typified by a condensed azo compound, an isoindolinone compound, an anthraquinone compound, an azo metal complex, a methine compound, and an allylamide compound.

As a black colorant, there are given carbon black and ones toned to black through the use of the yellow colorant, the magenta colorant, and the cyan colorant.

When the colorant is used, the colorant is preferably added and used in an amount of 1 part by mass or more and 20 parts by mass or less with respect to 100 parts by mass of the polymerizable monomer or the binder resin.

A magnetic material can also be incorporated into the toner particle of the present invention. In the present invention, the magnetic material can also serve as the colorant.

The magnetic material to be used in the present invention contains triiron tetroxide, γ-iron oxide, or the like as a main component, and may contain an element such as phosphorus, cobalt, nickel, copper, magnesium, manganese, or aluminum. Examples of the shape of the magnetic material include a polyhedron, an octahedron, a hexahedron, a spherical shape, a needle-like shape, and a scale shape. Of those, a shape having small anisotropy, such as a polyhedron, an octahedron, a hexahedron, or a spherical shape, is preferred for increasing an image density. The content of the magnetic material in the present invention is preferably 50 parts by mass or more and 150 parts by mass or less with respect to 100 parts by mass of the polymerizable monomer or the binder resin.

The toner particle of the present invention preferably contains a wax. A hydrocarbon-based wax is preferably contained as the wax. Additional examples of the wax include an amide wax, a higher fatty acid, a long-chain alcohol, a ketone wax, an ester wax, and derivatives such as grafted compounds and blocked compounds thereof. Two or more kinds of the waxes may be used in combination as required. When a hydrocarbon-based wax based on a Fischer-Tropsch method out of the waxes is used, the hot offset resistance can be satisfactorily maintained while its developability is satisfactorily maintained over a long time period. It should be noted that an antioxidant may be added to such hydrocarbon-based wax to the extent that the chargeability of the toner is not affected.

The content of the wax is preferably 4.0 parts by mass or more and 30.0 parts by mass or less, more preferably 4.0 parts by mass or more and 28.0 parts by mass or less with respect to 100 parts by mass of the binder resin.

In the toner of the present invention, a charge control agent can also be incorporated into the toner particle as required. The blending of the charge control agent stabilizes the charging characteristic, and hence can control its triboelectric charge quantity to an optimum value in accordance with a developing system.

A known agent can be utilized as the charge control agent, and a charge control agent having a high charging speed and capable of stably maintaining a constant charge quantity is particularly preferred. Further, when the toner particle is produced by a direct polymerization method, a charge control agent having a low polymerization-inhibiting property and substantially free of any matter soluble in an aqueous medium is particularly preferred. Examples of the charge control agent include: Spilon Black TRH, T-77, or T-95 (Hodogaya Chemical Co., Ltd.), BONTRON (trademark) S-34, S-44, S-54, E-84, E-88, or E-89 (Orient Chemical Industries Co., Ltd.), and nigrosine and a modified product thereof with a fatty acid metal salt or the like; quaternary ammonium salts, such as tributylbenzylammonium-1-hydroxy-4-naphthosulfonate and tetrabutylammonium tetrafluoroborate, an onium salt as an analog thereof, such as a phosphonium salt, and lake pigments thereof; triphenylmethane dyes and lake pigments thereof (as a laking agent, there are given, for example, phosphotungstic acid, phosphomolybdic acid, phosphotungstomolybdic acid, tannic acid, lauric acid, gallic acid, ferricyanic acid, and a ferrocyan compound); a metal salt of a higher fatty acid; diorganotin oxides, such as dibutyltin oxide, dioctyltin oxide, and dicyclohexyltin oxide; and organotin borates, such as dibutyltin borate, dioctyltin borate, and dicyclohexyltin borate; TP-302 and TP-415 (Hodogaya Chemical Co., Ltd.), BONTRON (trademark) N-01, N-04, or N-07, P-51 (Orient Chemical Industries Co., Ltd.), and Copy Blue PR (Clariant).

The toner of the present invention may contain only one kind of those charge control agents or two or more kinds thereof in combination.

The blending amount of the charge control agent is preferably 0.3 part by mass or more and 10.0 parts by mass or less, more preferably 0.5 part by mass or more and 8.0 parts by mass or less with respect to 100 parts by mass of the polymerizable monomer or the binder resin.

Next, an external addition and mixing apparatus that can be used in the present invention is described.

A known mixing treatment apparatus can be used as the mixing treatment apparatus for externally adding and mixing silica fine particles.

In the present invention, a Henschel mixer is preferably used as a mixing treatment apparatus for externally adding and mixing the silica fine particle B. In addition, such apparatus as illustrated in FIG. 1 is preferably used as a mixing treatment apparatus for externally adding and mixing the silica fine particle A in order that the adhesion of the silica fine particle A in the adhesive force-measuring method by using the polycarbonate thin film may be easily controlled to the range of the present invention.

FIG. 1 is a schematic view for illustrating an example of a mixing treatment apparatus that may be used for externally adding and mixing the silica fine particles to be used in the present invention.

The mixing treatment apparatus is configured to apply a shear to the toner particles and the silica fine particles in a small clearance portion, and hence the silica fine particles can be allowed to adhere to the surfaces of the toner particles while being loosened from secondary particles into primary particles. Further, as described later, in the axial direction of a rotary member, the toner particles and the silica fine particles easily circulate and are easily sufficiently uniformly mixed before their sticking proceeds. Consequently, the adhesion of the silica fine particle A in the adhesive force-measuring method by using the polycarbonate thin film is easily controlled.

Figure 2:
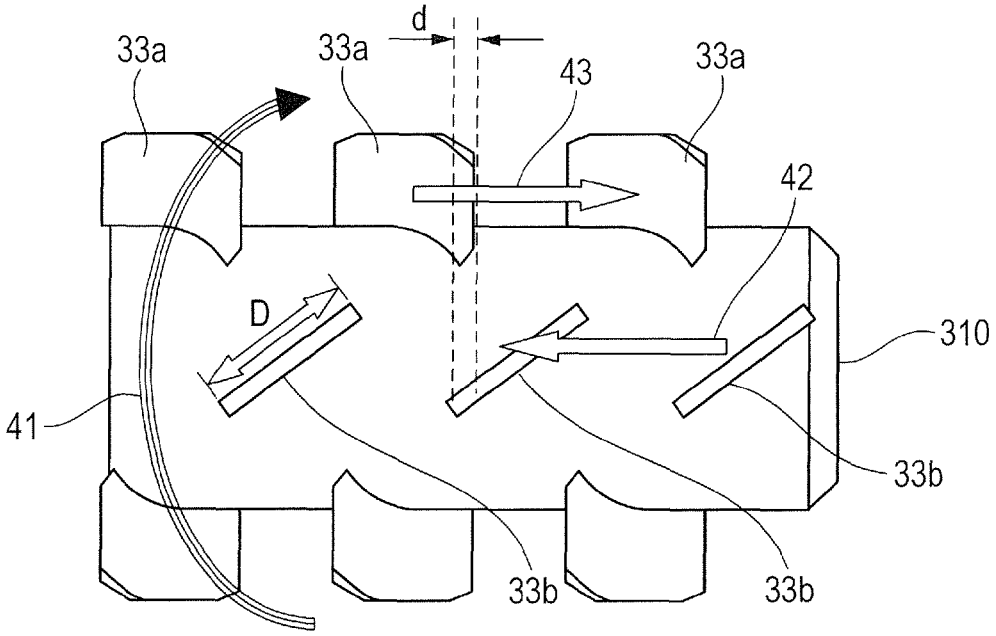
FIG. 2 is a schematic view for illustrating an example of the construction of a stirring member to be used in the mixing treatment apparatus.

Meanwhile, FIG. 2 is a schematic view for illustrating an example of the construction of stirring members to be used in the above-mentioned mixing treatment apparatus.

Now, the external addition and mixing step of the silica fine particles is described with reference to FIG. 1 and FIG. 2.

The mixing treatment apparatus for externally adding and mixing the silica fine particles (silica fine particles A) includes at least: the rotary member (rotary shaft) 32 having a plurality of stirring members (rotary blades) 33 arranged on a surface thereof; a driver section 38 configured to rotationally drive the rotary member; and a main body casing 31 having an inner peripheral surface arranged to have a gap between itself and each of the stirring members 33.

In order to uniformly apply a shear to the toner particles and thereby facilitate the adhesion of the silica fine particles onto the surfaces of the toner particles while loosening their secondary particles into primary particles, it is important for the gap (clearance) between the inner periphery of the main body casing 31 and each of the stirring members 33 to be kept constant and very small.

In addition, in this apparatus, the diameter of the inner periphery of the main body casing 31 is 2 or less times as large as the diameter of the outer periphery of the rotary member 32. FIG. 1 is an illustration of an example in which the diameter of the inner periphery of the main body casing 31 is 1.7 times as large as the diameter of the outer periphery of the rotary member 32 (the diameter of the body of the rotary member 32 excluding the stirring members 33). When the diameter of the inner periphery of the main body casing 31 is 2 or less times as large as the diameter of the outer periphery of the rotary member 32, a treatment space in which a force acts on the toner particles is appropriately restricted, and hence a sufficient impact force is applied to the silica fine particles that are present as secondary particles.

In addition, it is important to adjust the clearance depending on the size of the main body casing. Setting of the clearance to the range of from about 1% or more to 5% or less of the diameter of the inner periphery of the main body casing 31 is important for applying a sufficient shear to the silica fine particles. Specifically, when the diameter of the inner periphery of the main body casing 31 is about 130 mm, it is appropriate to set the clearance to the range of from about 2 mm or more to about 5 mm or less, and when the diameter of the inner periphery of the main body casing 31 is about 800 mm, it is appropriate to set the clearance to the range of from about 10 mm or more to about 30 mm or less.

In the external addition and mixing step of the silica fine particles in the present invention, the surfaces of the toner particles are subjected to external addition and mixing treatment with the silica fine particles using the mixing treatment apparatus by rotating the rotary member 32 by the driver section 38 and stirring and mixing the toner particles and the silica fine particles fed into the mixing treatment apparatus.

As illustrated in FIG. 2, at least some of the plurality of stirring members 33 are formed as forward stirring members 33*a* configured to transport the toner particles and the silica fine particles forward in one direction of the axial direction of the rotary member 32 along with the rotation of the rotary member 32. In addition, at least some of the plurality of stirring members 33 are formed as backward stirring members 33*b* configured to transport the toner particles and the silica fine particles backward in the other direction of the axial direction of the rotary member 32 along with the rotation of the rotary member 32. In this case, as illustrated in FIG. 1, when the raw material feed port 35 and the product discharge port 36 are arranged at both end portions of the main body casing 31, the direction toward the product discharge port 36 from the raw material feed port 35 (direction to the right in FIG. 1) is referred to as "forward direction".

That is, as illustrated in FIG. 2, the plate surfaces of the forward stirring members 33*a* are tilted so as to transport the toner particles in a forward direction 43. Meanwhile, the plate surfaces of the stirring members 33*b* are tilted so as to transport the toner particles and the silica fine particles in a backward direction 42.

In this manner, while transport in the "forward direction" 43 and transport in the "backward direction" 42 are repeatedly performed, the surfaces of the toner particles are subjected to external addition and mixing treatment with the silica fine particles. In addition, the stirring members 33*a* and 33*b* form sets each including a plurality of members arranged at an interval in the circumferential direction of the rotary member 32. In the example illustrated in FIG. 2, the stirring members 33*a* and 33*b* form sets each including two members at a mutual interval of 180 degrees on the rotary member 32. However, a large number of members may form a set, such as three members at an interval of 120 degrees or four members at an interval of 90 degrees.

In the example illustrated in FIG. 2, a total of twelve stirring members 33*a* and 33*b* are formed at an equal interval.

Further, in FIG. 2, the width of the stirring member is represented by D and a distance that represents an overlapping portion of the stirring members is represented by d. From the viewpoint of efficiently transporting the toner particles and the silica fine particles in the forward direction and the backward direction, the width D is preferably from about 20% or more to about 30% or less with respect to the length of the rotary member 32 in FIG. 2. In FIG. 2, an example of 23% is illustrated. Further, the stirring members 33*a* and 33*b* preferably have some degree of an overlapping portion d of stirring members with the stirring member 33*b* when a line is extended from an end portion position of the stirring member 33*a* in a vertical direction.

With this, a shear can be efficiently applied to the silica fine particles that are present as secondary particles. A ratio of d to D of from 10% or more to 30% or less is preferred for applying a shear.

It should be noted that other than the shape as illustrated in FIG. 2, the following blade shape may be adopted as long as the toner particles can be transported in the forward direction and the backward direction and the clearance can be maintained: a shape having a curved surface or a paddle structure in which an end blade portion is connected to the rotary member 32 by a rod-shaped arm.

The present invention is described in more detail below in accordance with the schematic views of the apparatus illustrated in FIG. 1 and FIG. 2.

The apparatus illustrated in FIG. 1 has at least the rotary member 32 having placed on its surface the plurality of stirring members 33, the driver section 38 configured to rotationally drive the rotary member 32, and the main body casing 31 arranged to have a gap between itself and each of the stirring members 33. The apparatus further has a jacket 34 arranged on the inside of the main body casing 31 and at an end portion side surface 310 of the rotary member, and through which a heat transfer medium can be flowed. 37 represents central axis.

The apparatus illustrated in FIG. 1 further has the raw material feed port 35 formed in an upper portion of the main body casing 31 and the product discharge port 36 formed in a lower portion of the main body casing 31. The raw material feed port 35 is used for introducing the toner particles and the silica fine particles, and the product discharge port 36 is used for discharging the toner subjected to external addition and mixing treatment from the main body casing 31 to the outside.

Further, in the apparatus illustrated in FIG. 1, a raw material feed port inner piece 316 is inserted into the raw material feed port 35, and a product discharge port inner piece 317 is inserted into the product discharge port 36.

In the present invention, first, the raw material feed port inner piece 316 is removed from the raw material feed port 35, and the toner particles are fed into a treatment space 39 from the raw material feed port 35. Next, the silica fine particles are fed into the treatment space 39 from the raw material feed port 35, and the raw material feed port inner piece 316 is inserted. Next, the rotary member 32 is rotated (in a rotation direction 41) by the driver section 38. Thus, the treatment materials fed as described above are subjected to external addition and mixing treatment while being stirred and mixed by the plurality of stirring members 33 arranged on the surface of the rotary member 32.

It should be noted that the following order of feeding may be adopted: first, the silica fine particles are fed from the raw material feed port 35, and then the toner particles are fed from the raw material feed port 35. In addition, the toner particles and the silica fine particles may be mixed in advance with a mixing machine, such as a Henschel mixer, before being fed as a mixture from the raw material feed port 35 of the apparatus illustrated in FIG. 1.

As a condition for the external addition and mixing treatment, the power of the driver section 38 is preferably controlled to the range of from 0.2 W/g or more to 2.0 W/g or less in order to control the adhesion of the silica fine particle A in the adhesive force-measuring method by using the polycarbonate thin film. In addition, the power of the driver section 38 is more preferably controlled to the range of from 0.6 W/g or more to 1.6 W/g or less. When the power of the driver section 38 is 0.2 W/g or more and 2.0 W/g or less, the silica fine particles can easily diffuse in the surface of the toner particles, and can easily mix with the toner particle without being excessively embedded in the toner particles. Accordingly, the adhesion of the silica fine particle A can be easily controlled and hence high flowability of the toner can be easily obtained.

A treatment time, which is not particularly limited, is preferably 3 minutes or more and 10 minutes or less. When the treatment time is 3 minutes or more, the silica fine particles can easily diffuse in the surface of the toner particles, and hence the adhesion of the silica fine particles A can be more easily controlled.

The number of revolutions of each of the stirring members at the time of the external addition and mixing is not particularly limited. In the apparatus illustrated in FIG. 1 in which the treatment space 39 has a volume of $2.0\times10^{-3}$ $m^3$, when the shapes of the stirring members 33 are set to those illustrated in FIG. 2, the number of revolutions of each of the stirring members is preferably 800 rpm or more and 3,000 rpm or less. When the number of revolutions is 800 rpm or more and 3,000 rpm or less, the adhesion of the silica fine particles A in the adhesive force-measuring method by using the polycarbonate thin film can be easily controlled.

In the present invention, the following two-stage mixing is preferably performed: as described in the foregoing, the toner particles and the silica fine particles B are mixed with each other once (step 1), and then the silica fine particles A are added to and mixed with the mixture (step 2).

Further, in the present invention, a particularly preferred treatment method involves a premixing step for each of the silica fine particles A or the silica fine particles B before the operation of the external addition and mixing treatment. When the premixing step is present, the silica fine particles are easily uniformly dispersed to a high degree on the surfaces of the toner particles. More specifically, as premixing treatment conditions, it is preferred to set the power of the driver section 38 to the range of from 0.06 W/g or more to 0.20 W/g or less and set a treatment time to the range of from 0.5 minute or more to 1.5 minutes or less.

When the load power serving as one premixing treatment condition is 0.06 W/g or more, or when the treatment time serving as the other premixing treatment condition is 0.5 minute or more, uniform mixing sufficient as premixing is performed. Meanwhile, when the load power serving as one premixing treatment condition is 0.20 W/g or less, or when the treatment time serving as the other premixing treatment condition is 1.5 minutes or less, the silica fine particles are prevented from being stuck to the surface of the toner particles before sufficient uniform mixing is performed.

With regard to the number of rotations of a stirring member in the premixing treatment, in an apparatus in which the treatment space 39 of the apparatus illustrated in FIG. 1 has a volume of $2.0\times10^{-3}$ $m^3$, the number of rotations of the stirring member when each of the stirring members 33 has the shape illustrated in FIG. 2 is preferably 50 rpm or more and 500 rpm or less. When the number of revolutions is 50 rpm or more and 500 rpm or less, the adhesion of the silica fine particles A in the adhesive force-measuring method by using the polycarbonate thin film specified in the present invention can be easily controlled.

After the completion of the external addition and mixing treatment, the product discharge port inner piece 317 in the product discharge port 36 is removed, and the toner is discharged from the product discharge port 36 by rotating the rotary member 32 by the driver section 38. As required, coarse particles and the like are separated from the resultant toner with a sieve, such as a circular oscillating sieve, to provide a finished toner.

The weight average particle diameter (D4) of the toner particle according to the present invention is preferably 5.0 μm or more and 10.0 μm or less, more preferably 5.5 μm or more and 9.5 μm or less from the viewpoint of a balance between the developability and the fixability.

In the present invention, the average circularity of the toner particle is preferably 0.960 or more, more preferably 0.970 or more, still more preferably 0.975 or more. An average circularity of the toner particle of 0.960 or more is preferred because of the following reason. The shape of the toner particle becomes a spherical shape or a shape close thereto, and hence the toner is excellent in flowability and can easily obtain uniform triboelectric chargeability. Accordingly, high developability can be easily maintained even in the latter half of the endurance use. In addition, toner particles having a high average circularity are preferred because the adhesion of the silica fine particle A in the adhesive force-measuring method by using the polycarbonate thin film can be easily controlled to the range of the present invention in the external addition and mixing treatment of the silica fine particles A and the silica fine particles B described above.

The production of the toner particles in an aqueous medium to be described later facilitates the control of the average circularity to the range. When the toner particles are produced by a pulverization method, the average circularity can be easily controlled to the range by performing heat sphering treatment, surface modification, and fine powder removal.

Now, a production method for the toner of the present invention is exemplified, but is not limited to the following.

The method of producing a toner of the present invention is not particularly limited, and the toner can be produced by a known method.

When the toner particles are produced by a pulverization method, for example, the binder resin and the colorant, and as required, any other additive, such as a wax, are sufficiently mixed with a mixer, such as a Henschel mixer or a ball mill. After that, the toner materials are dispersed or dissolved by melting and kneading the mixture with a heat kneader, such as a heating roll, a kneader, or an extruder, and the resultant is cooled to be solidified and then pulverized. After that, the pulverized product is classified, and as required, subjected to surface treatment to provide the toner particles. The classification may be performed prior to the surface treatment, and vice versa. In the classifying step, a multi-division classifier is preferably used in terms of production efficiency.

The pulverization can be performed by a method involving using a known pulverizing apparatus, such as a mechanical impact- or jet-type pulverizing apparatus. In addition, in order that the toner particles having a preferred average circularity of the present invention may be obtained, it is preferred to perform the pulverization while further applying heat, or to perform treatment involving applying a mechanical impact force in an auxiliary manner. In addition, a hot water bath method involving dispersing toner particles that have been finely pulverized (and classified as required) in hot water, a method involving passing the toner particles through a thermal air current, or the like may be used.

A method of applying the mechanical impact force is, for example, a method involving using a mechanical impact-type pulverizer, such as Criptron System manufactured by Kawasaki Heavy Industries, Ltd. or Turbo Mill manufactured by Turbo Kogyo Co., Ltd. Also available is a method involving applying the mechanical impact force to the toner particles through a force such as a compressive force or a frictional force like an apparatus such as Mechanofusion System manufactured by Hosokawa Micron Corporation or Hybridization System manufactured by Nara Machinery Co., Ltd.

The toner particles to be used in the present invention are preferably produced in an aqueous medium like a dispersion polymerization method, an association agglomeration method, a dissolution suspension method, a suspension polymerization method, and the like, and are more preferably produced by the suspension polymerization method. In the case of the production in the aqueous medium, for example, a polymerizable monomer composition containing the polymerizable monomer and the colorant is dispersed in the aqueous medium and granulated, and the polymerizable monomer in the granulated particles is polymerized, whereby the toner particles can be obtained.

In the suspension polymerization method, first, the polymerizable monomer and the colorant, and as required, other additives, such as the polymerization initiator, the crosslinking agent, and the charge control agent, are uniformly dissolved or dispersed to provide the polymerizable monomer composition. After that, the polymerizable monomer composition is dispersed in a continuous layer (e.g., an aqueous phase) containing a dispersion stabilizer with a proper stirrer. After that, the polymerizable monomer in the polymerizable monomer composition is polymerized to produce the binder resin, whereby toner particles having desired particle diameters are obtained. The toner particles obtained by the suspension polymerization method (hereinafter sometimes referred to as "polymerized toner particles") can easily satisfy a predetermined average circularity because the shapes of the respective toner particles are substantially uniformized to a spherical shape. In addition, the polymerized toner particles are preferred because the charge quantity distribution of the toner particles becomes relatively uniform.

In addition to the products given as the examples of the vinyl-based monomer, a known monomer can be used as the polymerizable monomer constituting the polymerizable monomer composition. Of those, styrene or a styrene derivative is preferably used alone or as a mixture with any other polymerizable monomer in terms of the developing characteristic and durability of the toner.

In the present invention, the polymerization initiator to be used in the suspension polymerization method is preferably one having a half-life of 0.5 hour or more and 30.0 hours or less in a polymerization reaction. In addition, the polymerization initiator is added in an amount of preferably 0.5 part by mass or more and 20.0 parts by mass or less with respect to 100 parts by mass of the polymerizable monomer.

Preferred specific examples of the polymerization initiator include the polymerization initiators described above, an azo- or diazo-based polymerization initiator, and a peroxide-based polymerization initiator.

In the suspension polymerization method, the crosslinking agent can be added in a polymerization reaction. The crosslinking agent is added in an amount of preferably 0.1 part by mass or more and 10.0 parts by mass or less with respect to 100 parts by mass of the polymerizable monomer. Examples of the crosslinking agent include the crosslinking agents that can be used for obtaining the vinyl resin described above.

In the present invention, the above-mentioned colorant can be used as the colorant to be used in the suspension polymerization method.

In the suspension polymerization method, when a magnetic material is used as the colorant, the magnetic material can be produced by, for example, the following method.

An aqueous solution containing ferrous hydroxide is prepared by adding, to an aqueous solution of a ferrous salt, an alkali, such as sodium hydroxide, in an amount equivalent to or more than that of an iron component. Air is blown into the prepared aqueous solution while the pH of the aqueous solution is maintained at 7 or more, and then the oxidation reaction of ferrous hydroxide is performed while the aqueous solution is warmed to 70° C. or more. Thus, a seed crystal serving as the core of magnetic iron oxide is produced first.

Next, about 1 equivalent of an aqueous solution containing ferrous sulfate with reference to the addition amount of the alkali added in advance is added to a slurry-like liquid containing the seed crystal. The magnetic iron oxide is grown with the seed crystal as the core by advancing the reaction of ferrous hydroxide while blowing air into the resultant liquid under a state in which the pH of the liquid is maintained at from 5 to 10. At this time, the shape and magnetic characteristic of the magnetic material can be controlled by selecting an arbitrary pH, an arbitrary reaction temperature, and an arbitrary stirring condition. As the oxidation reaction progresses, the pH of the liquid shifts to an acidic side but the pH of the liquid is preferably prevented from becoming less than 5. The magnetic material thus obtained is filtered, washed, and dried by an ordinary method, whereby a magnetic powder can be obtained.

In addition, in the present invention, when the toner is produced by a polymerization method, the surface of the magnetic material is extremely preferably subjected to hydrophobic treatment. When the surface treatment is performed by a dry method, the magnetic material that has been washed, filtered, and dried is treated with a coupling agent. When the surface treatment is performed by a wet method, the coupling treatment is performed by: redispersing, after the completion of the oxidation reaction, the dried product; or redispersing, after the completion of the oxidation reaction, an oxidized product obtained by the washing and the filtration in another aqueous medium without drying the product. Specifically, the coupling treatment is performed by: adding a silane coupling agent while sufficiently stirring the redispersion liquid; and increasing the temperature of the dispersion liquid after the hydrolysis, or adjusting the pH of the dispersion liquid to an alkaline region after the hydrolysis. Of those, the following procedure is preferred from the viewpoint that uniform surface treatment is performed: after the completion of the oxidation reaction, the magnetic material is directly re-slurried without being dried after the filtration and the washing, and is subjected to the surface treatment.

When the surface treatment of the magnetic material is performed by the wet method, i.e., the magnetic material is treated with the coupling agent in the aqueous medium, first, the magnetic material is sufficiently dispersed in the aqueous medium so as to be primary particles, and is stirred with a stirring blade or the like so as not to sediment or agglomerate. Next, an arbitrary amount of the coupling agent is loaded into the dispersion liquid, and the surface treatment is performed while the coupling agent is hydrolyzed. At this time as well, the surface treatment is more preferably performed while the magnetic material is sufficiently dispersed so as not to agglomerate with an apparatus such as a pin mill or a line mill under a state in which the stirring is performed.

Herein, the aqueous medium is a medium containing water as a main component. Specific examples thereof include the very water, a medium obtained by adding a small amount of a surfactant to water, a medium obtained by adding a pH adjustor to water, and a medium obtained by adding an organic solvent to water. The surfactant is preferably a nonionic surfactant, such as polyvinyl alcohol. The surfactant is preferably added at a content of from 0.1 mass % to 5.0 mass % with respect to water. Examples of the pH adjustor include inorganic acids, such as hydrochloric acid. Examples of the organic solvent include alcohols.

Examples of the coupling agent that can be used in the surface treatment of the magnetic material in the present invention include a silane compound, a silane coupling agent, and a titanium coupling agent. Of those, a silane compound or a silane coupling agent represented by the general formula (I) is preferably used.

$$R_mSiY_n \quad (I)$$

[In the formula, R represents an alkoxy group, m represents an integer of from 1 to 3, Y represents a functional group such as an alkyl group, a vinyl group, an epoxy group, or a (meth)acrylic group, and n represents an integer of from 1 to 3. It should be noted that a relationship of m+n=4 is satisfied.]

Examples of the silane coupling agent represented by the general formula (I) include vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, and hydroxypropyltrimethoxysilane. Examples of the silane compound represented by the general formula (I) can include methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, n-hexadecyltrimethoxysilane, and n-octadecyltrimethoxysilane.

Of those, an alkyltrialkoxysilane compound represented by the following general formula (II) is preferably used from the viewpoint of imparting high hydrophobicity to a magnetic material.

$$C_pH_{2p+1}—Si—(OC_qH_{2q+1})_3 \quad (II)$$

[In the formula, p represents an integer of from 2 to 20, and q represents an integer of from 1 to 3.]

When p in the formula represents 2 or more, hydrophobicity can be easily imparted to the magnetic material. In addition, when p represents 20 or less, the coalescence of the particles of the magnetic material can be easily suppressed. Further, the case where q represents 3 or less is preferred because the reactivity of the silane compound can easily improve. The alkyltrialkoxysilane compound represented by the formula in which p represents an integer of from 2 to 20, and q represents an integer of from 1 to 3 is preferably used.

When the silane compound or the silane coupling agent is used, the treatment can be performed by using one kind of such materials alone, or can be performed by using two or more kinds thereof in combination. When two or more kinds of such materials are used in combination, the magnetic material may be individually treated with each of the silane compounds and the coupling agents, or may be simultaneously treated with the materials.

In addition, in the present invention, the above-mentioned release agent and charge control agent can be used as the release agent and charge control agent to be used in the suspension polymerization method.

The production of the toner particles by the suspension polymerization method is specifically described below. However, the production is not limited thereto. First, the above-mentioned polymerizable monomer, colorant, and the like are appropriately added, and are uniformly dissolved or dispersed with a dispersing machine, such as a homogenizer, a ball mill, or an ultrasonic dispersing machine, to provide a polymerizable monomer composition, and the composition is suspended in an aqueous medium containing a dispersion stabilizer and granulated. At this time, when the sizes of the resultant particles are turned into desired toner particle sizes in one stroke with a dispersing machine, such as a high-speed stirring machine or an ultrasonic dispersing machine, the particle diameters of the toner particles to be obtained become sharp. With regard to the timing of the addition of a polymerization initiator, the initiator may be added simultaneously with the addition of any other additive to the polymerizable monomer, or may be mixed immediately before the suspension in the aqueous medium. In addition, the polymerization initiator dissolved in the polymerizable monomer or a solvent can be added immediately after the granulation and before the initiation of a polymerization reaction.

After the granulation, such stirring that particle states are maintained, and the floating and sedimentation of the particles are prevented only needs to be performed with an ordinary stirring machine.

A known surfactant or a known organic dispersant or inorganic dispersant can be used as the dispersion stabilizer. Of those, an inorganic dispersant can be preferably used for the following reasons: the inorganic dispersant hardly generates harmful ultrafine powder; the stability of the inorganic dispersant is hardly impaired even when a reaction temperature is changed, by virtue of its dispersion stability based on a steric hindrance property; and the inorganic dispersant can be easily washed and has little adverse effect on the toner. Examples of such inorganic dispersant include: polyvalent metal phosphates, such as tricalcium phosphate, magnesium phosphate, aluminum phosphate, zinc phosphate, and hydroxyapatite; carbonates, such as calcium carbonate and magnesium carbonate; inorganic salts, such as calcium metasilicate, calcium sulfate, and barium sulfate; and inorganic compounds, such as calcium hydroxide, magnesium hydroxide, and aluminum hydroxide.

Such inorganic dispersant is preferably used in an amount of 0.20 part by mass or more and 20.00 parts by mass or less with respect to 100 parts by mass of the polymerizable monomer. In addition, one kind of the dispersion stabilizers may be used alone, or two or more kinds thereof may be used in combination. Further, a surfactant may be used in combination in an amount of 0.0001 part by mass or more and 0.1000 part by mass or less with respect to 100 parts by mass of the polymerizable monomer. In the polymerization reaction of the polymerizable monomer, the polymerization temperature is set to a temperature of 40° C. or more, generally 50° C. or more and 90° C. or less.

After the completion of the polymerization of the polymerizable monomer, the resultant polymer particles are filtered, washed, and dried by known methods. Thus, toner particles are obtained. The toner of the present invention is obtained by externally adding and mixing inorganic fine particles into the toner particles so that the inorganic fine particles are allowed to adhere to the surfaces of the toner particles.

In addition, coarse powder and fine powder in the toner particles can be removed by incorporating a classifying step in the production steps (before the mixing of the inorganic fine particles).

The silica fine particles A and the silica fine particles B are incorporated into the toner of the present invention, but any other particle can be used to the extent that the effects of the present invention are not impaired. For example, a lubricant, such as fluorine resin powder, zinc stearate powder, or polyvinylidene fluoride powder, or an abrasive, such as cerium oxide powder, silicon carbide powder, or strontium titanate powder, can be used in such a small amount that the effects of the present invention are not affected.

Figure 3A:
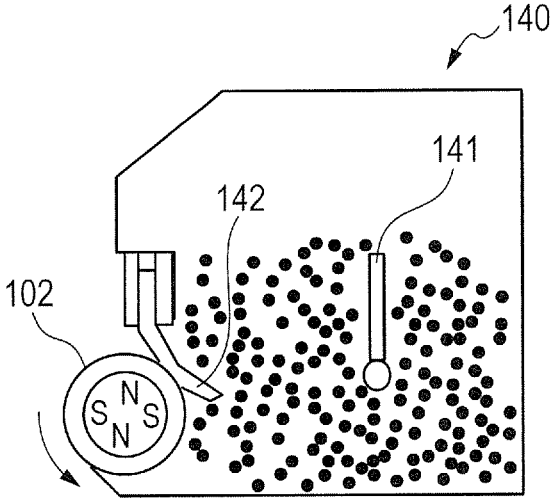
FIG. 3A and FIG. 3B are each a view for illustrating an example of an image-forming apparatus.
Figure 3B:
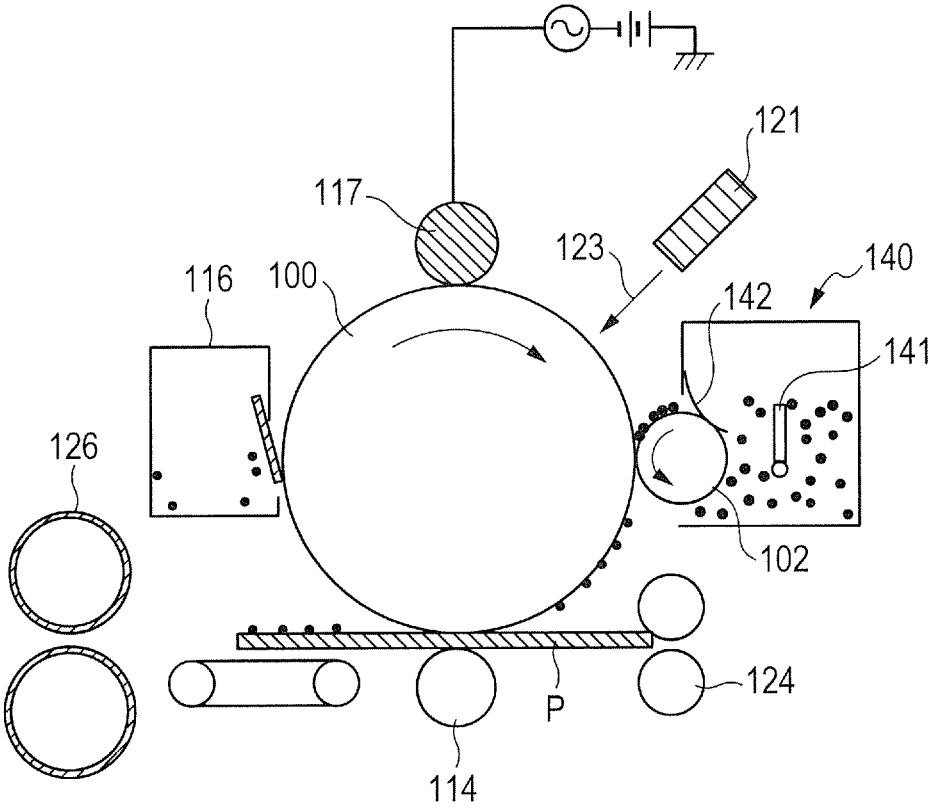

Next, an example of an image-forming apparatus in which the toner of the present invention can be suitably used is specifically described with reference to FIG. 3A and FIG. 3B. In FIG. 3A and FIG. 3B, around an electrostatic latent image-bearing member (hereinafter sometimes referred to as "photosensitive member") 100, there are arranged a charging member (charging roller) 117, a developing device 140 including a developer carrying member 102, a stirring member 141, and a toner regulating member 142, a transfer member (transfer charging roller) 114, a waste toner container 116, a fixing device 126, a pickup roller 124, and the like. The electrostatic latent image-bearing member 100 is charged by the charging roller 117. Then, the electrostatic latent image-bearing member 100 is exposed by being irradiated with laser light 123 by means of a laser-generating apparatus (latent image-forming unit, exposing apparatus) 121. Thus, an electrostatic latent image corresponding to an image of interest is formed. The electrostatic latent image on the electrostatic latent image-bearing member 100 is developed with a one-component toner by the developing device 140 to provide a toner image, and the toner image is transferred onto a transfer material P by the transfer charging roller 114, which is brought into contact with the electrostatic latent image-bearing member through the intermediation of the transfer material P. The transfer material having the toner image placed thereon is carried to the fixing device 126, and the toner image is fixed onto the transfer material. In addition, part of the toner remaining on the electrostatic latent image-bearing member is scraped off with a cleaning blade and stored in the waste toner container 116.

Next, measurement methods for physical properties according to the present invention are described.

<Measurement Method for Weight Average Particle Diameter (D4) of Toner>

The weight average particle diameter (D4) of the toner is calculated as described below (the weight average particle diameter of the toner particles is also calculated in the same manner). A precision particle size distribution measuring apparatus based on a pore electrical resistance method provided with a 100-μm aperture tube "Coulter Counter Multisizer 3" (trademark, manufactured by Beckman Coulter, Inc.) is used as a measuring apparatus. Dedicated software included with the apparatus "Beckman Coulter Multisizer 3 Version 3.51" (manufactured by Beckman Coulter, Inc.) is used for setting measurement conditions and analyzing measurement data. It should be noted that the measurement is performed at a number of effective measurement channels of 25,000.

An electrolyte aqueous solution prepared by dissolving reagent grade sodium chloride in ion-exchanged water so as to have a concentration of about 1 mass %, for example, "ISOTON II" (manufactured by Beckman Coulter, Inc.) can be used in the measurement.

It should be noted that the dedicated software is set as described below prior to the measurement and the analysis.

In the "Change Standard Operating Method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc.) is set as a Kd value. A threshold and a noise level are automatically set by pressing a "Threshold/Measure Noise Level" button. In addition, a current is set to 1,600 μA, a gain is set to 2, and an electrolyte solution is set to ISOTON II, and a check mark is placed in a check box "Flush Aperture Tube after Each Run."

In the "Convert Pulses to Size Settings" screen of the dedicated software, a bin spacing is set to a logarithmic particle diameter, the number of particle diameter bins is set to 256, and a particle diameter range is set to the range of from 2 μm to 60 μm.

A specific measurement method is as described below.

(1) About 200 mL of the electrolyte aqueous solution is charged into a 250-mL round-bottom glass beaker dedicated for Multisizer 3. The beaker is set in a sample stand, and the electrolyte aqueous solution in the beaker is stirred with a stirrer rod at 24 rotations/sec in a counterclockwise direction. Then, dirt and bubbles in the aperture tube are removed by the "Flush Aperture" function of the analysis software.

(2) About 30 mL of the electrolyte aqueous solution is charged into a 100-mL flat-bottom glass beaker. About 0.3 mL of a diluted solution prepared by diluting "Contaminon N" (a 10 mass % aqueous solution of a neutral detergent for washing a precision measuring device containing a nonionic surfactant, an anionic surfactant, and an organic builder and having a pH of 7, manufactured by Wako Pure Chemical Industries, Ltd.) with ion-exchanged water by three mass fold is added as a dispersant to the electrolyte aqueous solution.

(3) An ultrasonic dispersing unit "Ultrasonic Dispersion System Tetora 150" (manufactured by Nikkaki Bios Co., Ltd.) is prepared in which two oscillators each having an oscillatory frequency of 50 kHz are built so as to be out of phase by 180° and which has an electrical output of 120 W. About 3.3 L of ion-exchange water is charged into the water tank of the ultrasonic dispersing unit. About 2 mL of Contaminon N is added into the water tank.

(4) The beaker in the section (2) is set in the beaker fixing hole of the ultrasonic dispersing unit, and the ultrasonic dispersing unit is operated. Then, the height position of the beaker is adjusted so that the liquid level of the electrolyte aqueous solution in the beaker resonates to the fullest extent possible.

(5) About 10 mg of toner is gradually added to and dispersed in the electrolyte aqueous solution in the beaker in the section (4) under a state in which the electrolyte aqueous solution is irradiated with an ultrasonic wave. Then, the ultrasonic dispersion treatment is continued for an additional 60 seconds. It should be noted that the temperature of water in the water tank is appropriately adjusted to the range of from 10° C. or more to 40° C. or less upon ultrasonic dispersion.

(6) The electrolyte aqueous solution in the section (5) in which the toner has been dispersed is dropped with a pipette to the round-bottom beaker in the section (1) placed in the sample stand, and the concentration of the toner to be measured is adjusted to about 5%. Then, measurement is performed until 50,000 particles are measured.

(7) The measurement data is analyzed with the dedicated software included with the apparatus, and the weight average particle diameter (D4) is calculated. It should be noted that the "Arithmetic Diameter" on the "Analysis/Volume Statistics (Arithmetic Average)" screen of the dedicated software when the dedicated software is set to show a graph in a vol % unit is the weight average particle diameter (D4).

<Measurement Method for Number Average Particle Diameter of Primary Particle of Silica Fine Particle>

The number average particle diameter of primary particle of silica fine particle is calculated based on an image of silica fine particles on the surfaces of toner particles to be taken with ultrahigh resolution field-emission scanning electron microscope S-4800 (Hitachi High-Technologies Corporation). The imaging conditions of S-4800 are as described below.

(1) Sample Preparation

A conductive paste is thinly spread over a sample stage (aluminum sample stage measuring 15 mm×6 mm), and the toner is sprayed. Further, air is blown to remove an excess toner from the sample stage and to sufficiently dry. The sample stage is set in a sample holder and the height of the sample stage is adjusted to 36 mm with a sample height gauge.

(2) Setting of Conditions for Observation with 5-4800

The number average particle diameter of primary particle of the silica fine particle is calculated using an image obtained by reflected electron image observation with S-4800. Less charge-up of the silica fine particles occurs in a reflected electron image as compared to a secondary electron image, and hence the particle diameters of the silica fine particles can be precisely measured.

Liquid nitrogen is poured into an anti-contamination trap mounted to a microscope body of S-4800 until the liquid overflows, and the whole is left to stand for 30 minutes. The "PC-SEM" of S-4800 is activated to perform flashing (cleaning of an FE chip serving as an electron source). The acceleration voltage display portion of the control panel on the screen is clicked and the [Flashing] button is pressed to open the Flashing execution dialog.

Flashing is executed after the confirmation that the flashing intensity is 2. It is confirmed that the emission current due to the flashing is from 20 μA to 40 μA. The sample holder is inserted into the sample chamber of a microscope body of S-4800. [HOME] in the control panel is pressed to move the sample holder to the observation position.

The acceleration voltage display portion is clicked to open the HV setting dialog. The acceleration voltage is set to [0.8 kV] and the emission current is set to [20 μA]. In the [Basic] tab of the operation panel, the signal selection is set to [SE], and [Upper (U)] and [+BSE] are selected for a SE detector. [L.A.100] is selected in the selection box to the right of [+BSE], to thereby establish the mode for observation in a reflected electron image.

Also in the [Basic] tab of the operation panel, the probe current, focus mode, and WD in the block of electronic optical condition are set to [Normal], [UHR], and [3.0 mm], respectively. The [ON] button of the acceleration voltage display portion of the control panel is pressed to apply the acceleration voltage.

(3) Number Average Particle Diameter (D1) of Silica Fine Particle

The magnification display portion of the control panel is dragged to set the magnification to 100,000×(100 k). The focus knob [COARSE] in the operation panel is rotated, and after the image has been in focus to some degree, the aperture alignment is adjusted. The [Align] of the control panel is clicked to display the alignment dialog and [Beam] is selected. The STIGMA/ALIGNMENT knobs (X, Y) of the operation panel are rotated to move the displayed beam to the center of the concentric circle.

Next, [Aperture] is selected and the STIGMA/ALIGNMENT knobs (X, Y) are turned one at a time for adjustment so as to stop or minimize image movement. The aperture dialog is closed and the focus is adjusted by autofocusing. This operation is repeated two more times to adjust the focus.

After that, particle diameters are measured for at least 300 silica fine particles on the surface of the toner, and their average particle diameter is determined. Herein, some of the silica fine particles are present as an aggregate mass, and hence the maximum diameters of particles which can be confirmed to be primary particles are determined, and the arithmetic average of the maximum diameters thus obtained is calculated. Thus, the number average particle diameter (D1) of primary particle of the silica fine particle A and the number average particle diameter (D1) of primary particle of the silica fine particle B are obtained.

<Measurement Method for Half Width of Peak of Primary Particle in Weight-Based Particle Size Distribution of Silica Fine Particle B>

The half width of a peak of primary particle of the silica fine particle B in the present invention is measured by forcedly desorbing the silica fine particles B from the surface of the toner in order to measure states close to the states of presence of the silica fine particles B on the surface of the toner after their external addition and mixing.

The weight-based particle size distribution of the silica fine particle B is measured using a disc centrifugal particle size distribution-measuring apparatus DC24000 manufactured by CPS Instruments Inc. A measurement method is described below.

1) In the Case of Magnetic Toner

First, 0.5 mg of Triton-X100 (manufactured by Kishida Chemical Co., Ltd.) is added into 100 g of ion-exchanged water to prepare a dispersion medium. 1 g of the toner is added to 9 g of the dispersion medium, and dispersed for 5 minutes with an ultrasonic disperser. After that, a neodymium magnet is used to attract the toner particles to prepare a supernatant. Next, a measuring apparatus-dedicated syringe needle manufactured by CPS Instruments Inc. is mounted to the tip of All-Plastic Disposable Syringe (TGK) having mounted thereto a syringe filter (diameter: 13 mm/pore diameter: 0.45 μm) (manufactured by Advantec Toyo Kaisha, Ltd.), and 0.1 mL of the supernatant is collected. The supernatant collected with the syringe is injected into the disc centrifugal particle size distribution-measuring apparatus DC24000, and subjected to the measurement of the weight-based particle size distribution of the silica fine particle B.

Details of the measurement method are as described below.

First, a disc of the apparatus is rotated at 24,000 rpm with Motor Control in CPS software. After that, the following conditions are set in Procedure Definitions.

(1) Sample Parameter

Maximum Diameter: 0.5 μm

Minimum Diameter: 0.05 μm

Particle Density: 2.0 g/mL to 2.2 g/mL (density of silica; input a value in a sample to be used)

Particle Refractive Index: 1.43

Particle Absorption: OK

Non-Sphericity Factor: 1.1

(2) Calibration Standard Parameters

Peak Diameter: 0.226 μm

Half Height Peak Width: 0.1 μm

Particle Density: 1.389 g/mL

Fluid Density: 1.059 g/mL

Fluid Refractive Index: 1.369

Fluid Viscosity: 1.1 cps

After the above-mentioned conditions have been set, an automated gradient maker AG300 manufactured by CPS Instruments Inc. is used to prepare a density gradient solution formed of a 8 mass % sucrose aqueous solution and a 24 mass % sucrose aqueous solution, and 15 mL of the density gradient solution is injected into a measurement container.

After the injection, in order to prevent the evaporation of the density gradient solution, 1.0 mL of dodecane (manufactured by Kishida Chemical Co., Ltd.) is injected to form an oil film, followed by a wait of 30 minutes or more for stabilizing the apparatus.

After the wait, standard particles for calibration (weight-based median particle diameter: 0.226 μm) are injected with a 0.1-mL syringe into the measuring apparatus, and calibration is performed. After that, the supernatant collected in the foregoing is injected into the apparatus, and subjected to the measurement of a weight-based particle size distribution.

Figure 4:
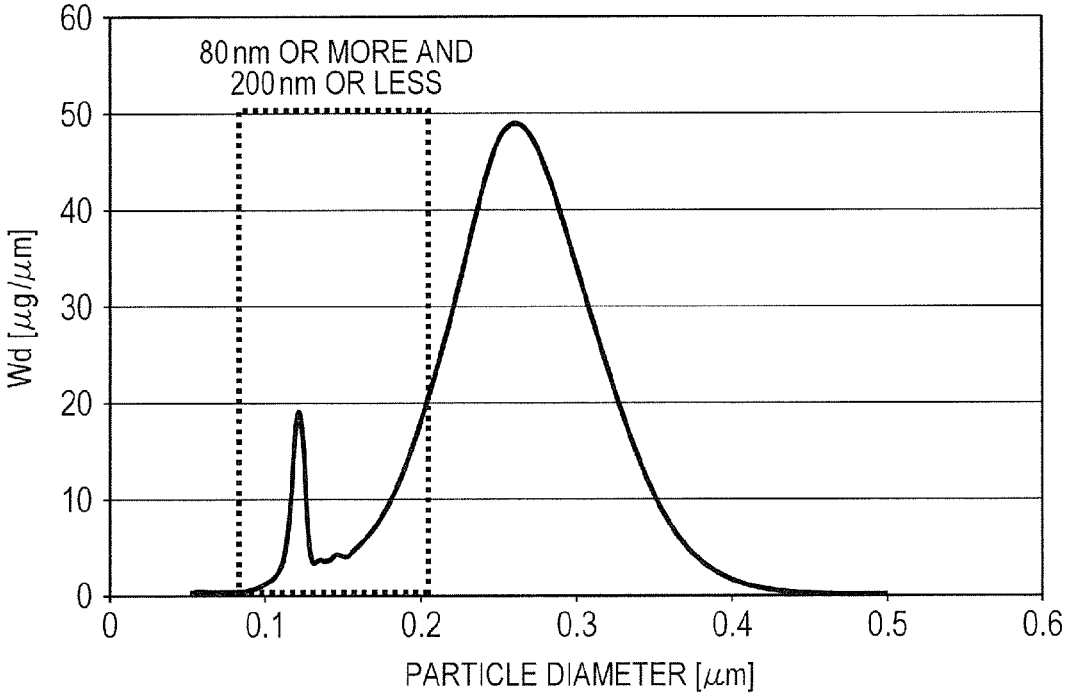
FIG. 4 is a chart for showing an example of measured data on the half width in a weight-based particle size distribution of silica fine particles B.

An example of the chart of the weight-based particle size distribution obtained by the measurement is shown in FIG. 4. As shown in FIG. 4, a peak is observed in a region of from 80 nm or more to 200 nm or less, and the half width of the peak is defined as the half width of the peak of primary particle in the weight-based particle size distribution. It should be noted that the silica fine particles A are not observed because a lower limit for the measurement is set to 0.05 μm, and a peak appearing in particle diameters larger than 200 nm in FIG. 4 is a peak derived from any other externally added particle.

2) In the Case of Non-Magnetic Toner

First, 0.5 mg of Triton-X100 (manufactured by Kishida Chemical Co., Ltd.) is added into 100 g of ion-exchanged water to prepare a dispersion medium. 0.6 g of the toner is added to 9.4 g of the dispersion medium, and dispersed for 5 minutes with an ultrasonic disperser. After that, a measuring apparatus-dedicated syringe needle manufactured by CPS Instruments Inc. is mounted to the tip of All-Plastic Disposable Syringe (TGK) having mounted thereto a syringe filter (diameter: 13 mm/pore diameter: 0.45 μm) (manufactured by Advantec Toyo Kaisha, Ltd.), and 0.1 mL of a supernatant is collected. The supernatant collected with the syringe is injected into the disc centrifugal particle size distribution-measuring apparatus DC24000, and subjected to the measurement of the weight-based particle size distribution of the silica fine particle B to determine the half width of the peak of the primary particles in the chart. Details of the measurement method are as described above.

<Measurement Method for Average Circularity of Toner Particle>

The average circularity of toner particle is measured under measurement and analysis conditions at the time of a calibration operation with a flow-type particle image analyzer "FPIA-3000" (manufactured by Sysmex Corporation).

A specific measurement method is as described below. First, about 20 mL of ion-exchanged water from which an impure solid and the like have been removed in advance is charged into a glass vessel. About 0.2 mL of a diluted solution prepared by diluting "Contaminon N" (a 10 mass % aqueous solution of a neutral detergent for washing a precision measuring unit containing a nonionic surfactant, an anionic surfactant, and an organic builder and having a pH of 7, manufactured by Wako Pure Chemical Industries, Ltd.) with ion-exchanged water by about three mass fold is added as a dispersant to the vessel.

Further, about 0.02 g of a measurement sample is added to the vessel, and then the mixture is subjected to dispersion treatment with an ultrasonic dispersing unit for 2 minutes so that a dispersion liquid for measurement may be obtained. At that time, the dispersion liquid is appropriately cooled so as to have a temperature of from 10° C. or more to 40° C. or less. A desktop ultrasonic cleaning and dispersing unit having an oscillatory frequency of 50 kHz and an electrical output of 150 W (such as "VS-150" (manufactured by VELVO-CLEAR)) is used as the ultrasonic dispersing unit. A predetermined amount of ion-exchanged water is charged into a water tank, and about 2 mL of the Contaminon N is added to the water tank.

The flow-type particle image analyzer provided with "UPlanApro" (magnification: 10, numerical aperture: 0.40) as an objective lens was used in the measurement, and a particle sheath "PSE-900A" (manufactured by Sysmex Corporation) was used as a sheath liquid. The dispersion liquid prepared in accordance with the procedure is introduced into the flow-type particle image analyzer, and 3,000 toner particles are subjected to measurement according to the total count mode of an HPF measurement mode. Then, the average circularity of the toner particle is determined with a binarization threshold at the time of particle analysis set to 85% and particle diameters to be analyzed limited to ones each corresponding to a circle-equivalent diameter of 1.985 μm or more and less than 39.69 μm.

In the measurement, automatic focusing is performed with standard latex particles (obtained by diluting, for example, "RESEARCH AND TEST PARTICLES Latex Microsphere Suspensions 5200A" manufactured by Duke Scientific with ion-exchanged water) prior to the initiation of the measurement. After that, focusing is preferably performed every two hours from the initiation of the measurement.

It should be noted that in the present invention, a flow-type particle image analyzer which has been subjected to a calibration operation by Sysmex Corporation and has received a calibration certificate issued by Sysmex Corporation is used. The measurement is performed under measurement and analysis conditions identical to those at the time of the reception of the calibration certificate except that particle diameters to be analyzed are limited to ones each corresponding to a circle-equivalent diameter of 1.985 μm or more and less than 39.69 μm.

The measurement principle of the flow-type particle image-measuring apparatus "FPIA-3000" (manufactured by Sysmex Corporation) is as follows: a flowing particle is photographed as a still image, and the image is analyzed. A sample added to a sample chamber is fed into a flat sheath flow cell with a sample suction syringe. The sample fed into the flat sheath flow cell is sandwiched between sheath liquids to form a flat flow.

The sample passing the inside of the flat sheath flow cell is irradiated with strobe light at an interval of 1/60 second, and hence the flowing particle can be photographed as a still image. In addition, the particle is photographed in a focused state because the flow is flat. The particle image is photographed with a CCD camera, the photographed image is subjected to image processing at an image processing resolution of 512×512 pixels (0.37×0.37 μm per pixel), and the borderline of each particle image is sampled, whereby a projected area S, a perimeter L, and the like of the particle image are measured.

Next, a circle-equivalent diameter and a circularity are determined by using the area S and the perimeter L. The circle-equivalent diameter is the diameter of a circle having the same area as the projected area of the particle image, and the circularity is defined as a value obtained by dividing the perimeter of the circle determined from the circle-equivalent diameter by the perimeter of the particle projected image, and is calculated from the following equation.

$$\text{Circularity}=2\times(\pi\times S)^{1/2}/L$$

When the particle image is circular, the circularity becomes 1.000, and the circularity takes a smaller value as the degree of unevenness of the outer periphery of the particle image increases. After the circularities of the respective particles have been calculated, the circularity range of from 0.200 to 1.000 is divided into 800 sections, the arithmetic average of the resultant circularities is calculated, and the value is defined as the average circularity.

<Method of Measuring Carbon Amount-Based Fixation Ratio of Silicone Oil in Silica Fine Particle>

(Extraction of Liberated Silicone Oil)

(1) 0.50 Gram of silica fine particles and 40 ml of chloroform are loaded into a beaker, and the mixture is stirred for 2 hours.

(2) The stirring is stopped and the mixture is left at rest for 12 hours.

(3) The sample is filtered and washed with 40 ml of chloroform three times.

(Carbon Amount Measurement)

In a stream of oxygen, the sample is burned at 1,100° C., and the amount of carbon in the sample is measured by measuring the amounts of produced CO and $CO_2$ based on their IR absorbances. Carbon amounts before and after the extraction of the silicone oil are compared, and the carbon amount-based fixation ratio of the silicone oil is calculated as described below.

(1) 0.40 Gram of the sample is loaded into a cylindrical mold and pressed.

(2) 0.15 Gram of the pressed sample is precisely weighed, mounted on a combustion board, and subjected to measurement with EMA-110 manufactured by Horiba, Ltd.

(3) A value calculated from the expression "[carbon amount after extraction of silicone oil]/[carbon amount before extraction of silicone oil]×100" is defined as the carbon amount-based fixation ratio of the silicone oil.

It should be noted that when surface treatment with the silicone oil is performed after hydrophobic treatment with an alkoxysilane or a silazane, the amount of carbon in the sample is measured after the hydrophobic treatment with the alkoxysilane or the silazane, and after the silicone oil treatment, the carbon amounts before and after the extraction of the silicone oil are compared, and a carbon amount-based fixation ratio derived from the silicone oil is calculated as described below.

(4) A value calculated from the expression "[carbon amount after extraction of silicone oil−carbon amount of sample after hydrophobic treatment with alkoxysilane or silazane]/[(carbon amount before extraction of silicone oil−carbon amount of sample after hydrophobic treatment with alkoxysilane or silazane)]×100" is defined as the carbon amount-based fixation ratio of the silicone oil.

On the other hand, when the hydrophobic treatment with the alkoxysilane or the silazane is performed after the surface treatment with the silicone oil, the carbon amount-based fixation ratio derived from the silicone oil is calculated as described below by using the sample after the surface treatment with the silicone oil.

(5) A value calculated from the expression "[(carbon amount after extraction of silicone oil of sample after surface treatment with silicone oil)]/[carbon amount before extraction of sample after surface treatment with silicone oil]×100" is defined as the carbon amount-based fixation ratio of the silicone oil.

<Method of measuring Apparent Density of Silica Fine Particle>

The apparent density of silica fine particle is measured as described below. The measurement sample mounted on paper is slowly added to a 100-ml measuring cylinder so as to have a volume of 100 ml, a difference between the masses of the measuring cylinder before and after the addition of the sample is determined, and the apparent density is calculated from the following equation. It should be noted that when the sample is added to the measuring cylinder, attention should be paid so that the paper may not be tapped.

Apparent density (g/L)=(mass (g) at the time of loading of 100 ml)/0.1

<Measurement of BET Specific Surface Area of Silica Fine Particle>

The measurement of a specific surface area based on nitrogen adsorption by the BET method is performed in conformity with JIS Z 8830 (2001). Used as a measuring apparatus is an "automatic specific surface area/pore distribution-measuring apparatus TriStar3000 (manufactured by Shimadzu Corporation)" adopting a gas adsorption method based on a constant volume method as a measuring system.

<Method of measuring True Specific Gravity of Silica Fine Particle>

The true specific gravity of silica fine particle is measured with a dry automatic densimeter Autopycnometer (manufactured by Yuasa Ionics). Conditions for the measurement are as described below.

Cell: SM cell (10 ml)

Sample amount: 0.05 g

The measurement method involves measuring the true specific gravity of a solid or a liquid based on a vapor phase substitution method. The method is based on Archimedes' principle as in a liquid phase substitution method, but has high accuracy for a fine pore because the method involves using a gas (argon gas) as a substitution medium.

<Adhesive Force-Measuring Method by Using Polycarbonate Thin Film>

The adhesion of the silica fine particle A in the adhesive force-measuring method by using a polycarbonate thin film in the present invention is calculated by analyzing a toner surface image, which has been taken with a Hitachi ultra-high resolution field-emission scanning electron microscope S-4800 (Hitachi High-Technologies Corporation), with an image analysis software Image-Pro Plus ver. 5.0 (Nippon Roper K.K.). Conditions under which the image is taken with the S-4800 are as described below.

(1) Sample Preparation

A conductive paste was thinly spread over a sample stage (aluminum sample stage measuring 15 mm×6 mm) in a square shape measuring 1 mm×1 mm, and a polycarbonate thin film (bisphenol Z type, trade name: Iupilon 2200, manufactured by Mitsubishi Gas Chemical Company, Inc., thin film having a square shape measuring 1.0 mm×1.0 mm) was bonded so as to cover the paste.

0.4 Milligram of a toner is mounted on the polycarbonate thin film, and the entirety of the polycarbonate thin film is uniformly covered with the toner by repeating the following procedure 30 times: the sample stage is lifted by a height of 5 mm, and is caused to fall by its self-weight without being accelerated. Next, the air of a nitrogen gas having an air pressure of 0.2 MPa is blown against the polycarbonate thin film for 3 seconds by using an air duster gun (K-601-0, Kinki Factory) while the gun is caused to maintain an angle of 45° relative to the surface direction of the polycarbonate thin film and a distance of 1.0 cm from the center of gravity of the square of the polycarbonate thin film.

(2) Setting of Conditions for Observation with S-4800

The measurement of the adhesion of the silica fine particle A in the adhesive force-measuring method by using the polycarbonate thin film is performed by using an image obtained by observing a reflected electron image with the S-4800. The reflected electron image is reduced in charge-up of the inorganic fine particles as compared to a secondary electron image, and hence the measurement of the adhesion of the silica fine particle A in the adhesive force-measuring method by using the polycarbonate thin film can be performed with high accuracy.

Liquid nitrogen is poured into an anti-contamination trap mounted to a microscope body of the 5-4800 until the liquid overflows, and the whole is left to stand for 30 minutes. The "PC-SEM" of the S-4800 is activated to perform flashing (cleaning of an FE chip serving as an electron source). The acceleration voltage display portion of the control panel on the screen is clicked and the [Flashing] button is pressed to open the Flashing execution dialog. Flashing is executed after the confirmation that the flushing intensity is 2. It is confirmed that the emission current due to the flushing is from 20 μA to 40 μA. The sample holder is inserted into the sample chamber of a microscope body of S-4800. [HOME] in the control panel is pressed to move the sample holder to the observation position.

The acceleration voltage display portion is clicked to open the HV setting dialog. The acceleration voltage is set to [0.8 kV] and the emission current is set to [20 μA]. In the [Basic] tab of the operation panel, the signal selection is set to [SE], and [Upper (U)] and [+BSE] are selected for an SE detector. [L.A.100] is selected in the selection box to the right of [+BSE], to thereby establish the mode for observation in a reflected electron image. Also in the [Basic] tab of the operation panel, the probe current, focus mode, and WD of the block of electronic optical condition are set to [Normal], [UHR], and [3.0 mm], respectively. The [ON] button of the acceleration voltage display portion of the control panel is pressed to apply the acceleration voltage.

(3) Focus Adjustment

The inside of the magnification display portion of the control panel is dragged to set the magnification to 5,000 (5 k). The focus knob [COARSE] of the operation panel is rotated, and after the image has been in focus to some degree, the aperture alignment is adjusted. The [Align] of the control panel is clicked to display the alignment dialog and [Beam] is selected. The STIGMA/ALIGNMENT knobs (X, Y) of the operation panel are rotated to move the displayed beam to the center of the concentric circle. Next, [Aperture] is selected and the STIGMA/ALIGNMENT knobs (X, Y) are turned one at a time for adjustment so as to stop or minimize image movement. The aperture dialog is closed and the focus is adjusted by autofocusing. This operation is repeated two or more times to adjust the focus.

Next, under a state in which the silica fine particles present on the sample stage are positioned at the center of a measurement screen, the inside of the magnification display portion of the control panel is dragged to set the magnification to 10,000 (10 k). The focus knob [COARSE] of the operation panel is rotated, and after the image has been in focus to some degree, the aperture alignment is adjusted. The [Align] of the control panel is clicked to display the alignment dialog and [Beam] is selected. The STIGMA/ALIGNMENT knobs (X, Y) of the operation panel are rotated to move the displayed beam to the center of the concentric circle. Next, [Aperture] is selected and the STIGMA/ALIGNMENT knobs (X, Y) are turned one at a time for adjustment so as to stop or minimize image movement. The aperture dialog is closed and the focus is adjusted by autofocusing. After that, the magnification is set to 20,000 (20 k), the focus adjustment is performed with the focus knob and the STIGMA/ALIGNMENT knobs in the same manner as in the foregoing, and the focus is adjusted again by autofocusing. This operation is repeated again to adjust the focus. Here, when the tilt angle of a surface to be observed is large, the accuracy with which the adhesion of the silica fine particles A is measured is liable to reduce. Accordingly, a toner particle whose surface has as small a tilt as possible is selected and analyzed by selecting such a toner particle that the entire surface to be observed is simultaneously in focus upon focus adjustment.

(4) Image Storage

Brightness adjustment is performed according to an ABC mode, and a photograph is taken at a size of 640×480 pixels and stored. The following analysis is performed with the image file. In this case, 300 images were obtained by performing observation in 300 fields of view at randomly selected sites at an observation magnification of 20 k.

(5) Image Analysis

In the present invention, the adhesion of the silica fine particle A is calculated by subjecting the image obtained by the approach described above to binary coded processing with the following analysis software.

Analysis conditions for the image analysis software Image-Pro Plus ver. 5.0 are as described below. Software: Image-Pro Plus 5.1J "Calibration" and "Spatial Calibration" are selected from the "Measure" of a tool bar in the stated order to set the scales of the conditions for the actual observation with the S-4800 so that the particle diameter and area of silica on the image can be measured in actual values. Next, the "Rectangle AOI" of the tool bar is selected to select a portion except character information displayed on the image, followed by setting so that the area of a rectangle may be 28.2 $\mu m^2$. Next, "Measure" and "Count/size" are selected, and "Manual Sampling" is selected to set a threshold so that the silica fine particles on the image may be colored, thereby performing setting so that the silica fine particles may be colored. In addition, "Area" is selected from "Measurements" in the "Measure" of "Count/Size" to perform setting so that area measurement can be performed. Next, the "Count" of "Count/size" is executed, and "Fill Holes" in the "Edit" of "Count/size" is executed to confirm that the silica fine particles to be measured are colored and correctly selected. In addition, when a foreign matter except the silica fine particles is present on the sample stage, "Remove Objects" is selected from the "Edit" of "Count/Size" to remove the foreign matter of interest. After the foregoing operations have been terminated, the "Count" of "Count/Size" is executed, and in order to acquire the measured area, "File" and "Copy Data to Clipboard" are selected to paste data (the areas of the respective silica fine particles) to the Excel, followed by the determination of the adhesion of the silica fine particle A by the following method. The foregoing measurement was performed on 300 observed images.

(6) How to Determine Adhesion of Silica Fine Particle A

Areas of $5.0\times10^3$ $nm^2$ or less are selected from the areas of the respective silica fine particles obtained in the section (5), and the sum of the areas is determined. The sum is defined as the adhesion of the silica fine particle A in the adhesive force-measuring method by using the polycarbonate thin film. Therefore, the ratio of the adhesion of the silica fine particle A relative to 100% by area of the total area of the polycarbonate thin film is calculated as described below.

[Ratio of adhesion of silica fine particle A in adhesive force-measuring method by using polycarbonate thin film obtained from one image]= [sum of areas of silica fine particles of 5,000 $nm^2$ or less/area of entirety of polycarbonate thin film (28.2 $\mu m^2$)]

The [ratio of the adhesion of the silica fine particle A in the adhesive force-measuring method by using the polycarbonate thin film] was determined as described above, the calculation was performed on all of the 300 observed images, and the average of the calculated values was defined as the [area ratio of the amount of the adhering silica fine particle A when the total area of the polycarbonate thin film was defined as 100% by area], i.e. the adhesion of the silica fine particle A in claims. It should be noted that the reason why the adhesion of the silica fine particle A is defined as the sum of the areas of the silica fine particles of $5.0\times10^3$ $nm^2$ or less is as described below. In the present invention, the minimum number average particle diameter of the silica fine particle B is 80 nm, and when it is hypothesized that the silica fine particle B is spheres, the minimum area of the silica fine particle B is $40\times40\times\pi\approx5.0\times10^3$ $nm^2$. Therefore, silica fine particles each having an area of $5.0\times10^3$ $nm^2$ or less can be identified as the silica fine particle A.

In addition, the adhesive force measurement by using the polycarbonate thin film can be similarly performed on a toner containing a material except the silica fine particles. The elements of the respective fine particles can be specified by using elemental analysis, such as EDAX, when the reflected electron image is observed with the S-4800. At this time, the fine particles except the silica fine particles are recorded, and "Remove Objects" is performed at the time of the image analysis of the section (5), whereby the fine particles can be removed from the object of the adhesion of the silica fine particle A.

Now, the present invention is described more specifically by way of Production Examples and Examples. It should be noted that, in each of the following formulations, "part(s)" refers to "part(s) by mass".

<Production Example of Magnetic Material>

(Magnetic Material 1)

An aqueous solution containing ferrous hydroxide was prepared by mixing, in an aqueous solution of ferrous sulfate, 1.00 equivalent to 1.10 equivalents of a caustic soda solution with respect to an iron element, 0.12 mass % of $P_2O_5$ in terms of a phosphorus element with respect to the iron element, and 0.60 mass % of $SiO_2$ in terms of a silicon element with respect to the iron element. The pH of the aqueous solution was set to 8.0, and an oxidation reaction was performed at 85° C. while air was blown into the solution. Thus, a slurry liquid containing a seed crystal was prepared.

Next, 0.90 equivalent to 1.20 equivalents of an aqueous solution of ferrous sulfate with respect to the original alkali amount (the sodium component of the caustic soda) was added to the slurry liquid. After that, the pH of the slurry liquid was maintained at 7.6, and an oxidation reaction was advanced while air was blown into the liquid. Thus, a slurry liquid containing magnetic iron oxide was obtained. After having been filtered and washed, the water-containing slurry liquid was taken out once. At this time, a small amount of the water-containing sample was collected and its water content was measured. Next, the water-containing sample was loaded into another aqueous medium without being dried, and the mixture was stirred. At the same time, the slurry was redispersed with a pin mill while being circulated, whereby the pH of the redispersion liquid was adjusted to about 4.8. Then, hydrolysis was performed by adding 1.7 parts of a n-hexyltrimethoxysilane coupling agent with respect to 100 parts of the magnetic iron oxide (the amount of the magnetic iron oxide was calculated as a value obtained by subtracting the water content from the water-containing sample) while stirring the redispersion liquid. After that, surface treatment was performed by sufficiently stirring the dispersion liquid to set to its pH to 8.6. A produced hydrophobic magnetic material was filtered with a filter press and washed with a large amount of water, and was then dried at 100° C. for 15 minutes and at 90° C. for 30 minutes. The resultant particles were subjected to shredding treatment to provide a magnetic material 1 having a volume average particle diameter of 0.23 μm.

(Magnetic Material 2)

A slurry liquid was prepared in the same manner as in the production example of the magnetic material 1 except that no phosphorus element was added and 0.40 mass % of $SiO_2$ in terms of a silicon element was mixed. An oxidation reaction was advanced in the same manner as in the production example of the magnetic material 1 to provide a slurry liquid containing magnetic iron oxide.

After the slurry liquid had been filtered, washed, and dried, the resultant particles were subjected to shredding treatment to provide a magnetic material 2 having a volume average particle diameter of 0.21 μm.

<Synthesis of Polyester Resin>

The following components were loaded into a reaction vessel provided with a cooling tube, a stirring machine, and a nitrogen-introducing tube, and were subjected to a reaction at 230° C. in a stream of nitrogen for 10 hours while produced water was distilled off. "EO" represents ethylene oxide, and "PO" represents propylene oxide.

| | |
|---|---|
| Bisphenol A EO (2 mole) adduct | 350 parts |
| Bisphenol A PO (2 mole) adduct | 326 parts |
| Terephthalic acid | 250 parts |
| Titanium-based catalyst (titanium dihydroxybis(triethanolaminate)) | 2 parts |

Next, the resultant was subjected to a reaction under a reduced pressure of from 5 mmHg to 20 mmHg. When the acid value of the resultant became 0.1 or less, the resultant was cooled to 180° C. and 80 parts by mass of trimellitic anhydride was added to the resultant. The mixture was subjected to a reaction at normal pressure in a sealed space for 2 hours, and then the resultant was taken out and cooled to room temperature. After that, the cooled product was pulverized to provide a polyester resin. The resultant resin had an acid value of 8 mgKOH/g.

<Toner Particle Production Example 1>

450 Parts of a 0.1 mol/L-$Na_3PO_4$ aqueous solution was fed into 720 parts of ion-exchanged water, and the mixture was warmed to a temperature of 60° C. After that, 67.7 parts of a 1.0 mol/L-$CaCl_2$ aqueous solution was added to provide an aqueous medium containing a dispersion stabilizer.

| | |
|---|---|
| Styrene | 78 parts |
| n-Butyl acrylate | 22 parts |
| Divinylbenzene | 0.5 part |
| Polyester resin | 10 parts |
| Negative charge control agent T-77 (manufactured by Hodogaya Chemical Co., Ltd.) | 1 part |
| Magnetic material 1 | 70 parts |

The above-mentioned formulation was uniformly dispersed and mixed using an attritor (manufactured by Mitsui Miike Chemical Engineering Machinery Co., Ltd.). The resultant monomer composition was warmed to a temperature of 60° C., and the following materials were mixed and dissolved therein to prepare a polymerizable monomer composition.

| | |
|---|---|
| Release agent paraffin wax (HNP-9: manufactured by Nippon Seiro | 15 parts |
| Polymerization initiator t-butyl peroxypivalate | 10 parts (25% tolulene liquid) |

The polymerizable monomer composition was fed into the aqueous medium, and the mixture was granulated by being stirred at a temperature of 60° C. under a $N_2$ atmosphere with TK Homomixer (manufactured by Tokushu Kika Kogyo Co., Ltd.) at 12,500 rpm for 15 minutes. After that, the mixture was stirred with a paddle stirring blade to be subjected to a polymerization reaction at a reaction temperature of 70° C. for 300 minutes. After that, the suspension liquid was cooled at 3° C./min to room temperature, and hydrochloric acid was added to dissolve the dispersant, followed by filtration, water washing, and drying to provide magnetic toner particles 1. The weight average particle diameter (D4) and the average circularity of the magnetic toner particles 1 were 8.0 μm and 0.979, respectively.

<Toner Particle Production Examples 2 and 3>

Toner particles 2 and 3 were produced in the same manner as in Toner Particle Production Example 1 except that the number of revolutions of the homomixer was reduced from 12,500 rpm to 11,000 rpm and 9,500 rpm, respectively. The physical properties of the resultant toner particles 2 and 3 are shown in Table 1.

<Toner Particle Production Example 4>

| | |
|---|---|
| Styrene acrylic copolymer (mass ratio between styrene and n-butyl acrylate: 78.0:22.0, molecular weight of main peak Mp: 10,000) | 100 parts |
| Magnetic material 2 | 90 parts |
| Iron complex of monoazo dye (T-77: Hodogaya Chemical Co., Ltd.) | 2.0 parts |

-continued

| | |
|---|---|
| Fischer-Tropsch wax (melting point: 74° C., number average molecular weight Mn: 500) | 4 parts |

The mixture was premixed with a Henschel mixer, and was then melted and kneaded with a biaxial extruder heated to 110° C. The kneaded product was cooled and then coarsely pulverized with a hammer mill to provide a toner coarsely pulverized product. The resultant coarsely pulverized product was subjected to mechanical pulverization (finely pulverized) with a mechanical pulverizer Turbo Mill (manufactured by Turbo Kogyo Co., Ltd.; the surfaces of a rotor and a stator were coated with chromium alloy plating containing chromium carbide (plating thickness: 150 μm, surface hardness: HV1050)). Fine powder and coarse powder were simultaneously classified and removed from the resultant finely pulverized product with a multi-division classifying apparatus utilizing a Coanda effect (Elbow Jet Classifier manufactured by Nittetsu Mining Co., Ltd.). Thus, toner particles A were obtained.

The toner particles A were subjected to heat sphering treatment. The heat sphering treatment was performed using Surfusing System (manufactured by Nippon Pneumatic Mfg. Co., Ltd.). The operation conditions of the heat sphering apparatus were set as follows: feed rate=5 kg/hr, hot air temperature C=260° C., hot air flow rate=6 $m^3$/min, cold air temperature E=5° C., cold air flow rate=4 $m^3$/min, absolute moisture content of cold air=3 g/$m^3$, blower air rate=20 $m^3$/min, injection air flow rate=1 $m^3$/min, diffusing air=0.3 $m^3$/min.

Toner particles 4 having a weight average particle diameter (D4) of 8.2 μm were obtained by the surface treatment under the foregoing conditions. The physical properties of the resultant toner particles 4 are shown in Table 1.

<Production Example 1 of Silica Fine Particles A>

Dry silica having a BET specific surface area of 300 $m^2$/g (average primary particle diameter=8 nm) was loaded into an autoclave with a stirring machine. Under a nitrogen atmosphere, 20 parts of a dimethyl silicone oil (kinematic viscosity: 50 cSt) was added to 100 parts of the dry silica, and the mixture was held at 250° C. for 30 minutes.

Subsequently, 10 parts of hexamethyldisilazane (hereinafter described as "HMDS" in tables) was added to the mixture. After that, the reactor was purged with a nitrogen gas, and the reactor was sealed. 10 Parts of hexamethyldisilazane with respect to 100 parts of the dry silica was sprayed into the reactor, and silane compound treatment was performed in a fluidized state of the silica while the mixture in the reactor was heated to 200° C. The reaction was continued for 60 minutes and then the reaction was completed. After the completion of the reaction, the autoclave was depressurized, and washing with a nitrogen gas stream was performed to remove excess hexamethyldisilazane and a by-product from the resultant hydrophobic silica.

After that, the resultant silica was taken out and then subjected to shredding treatment to provide silica fine particles A1. The physical properties of the silica fine particles A1 are shown in Table 2. "Oil fixation ratio" in Table 2 represents "carbon amount-based fixation ratio of the silicone oil".

<Production Examples 2 to 7 of Silica Fine Particles A>

Silica fine particles A2 to A7 were obtained in the same manner as in the production example 1 of the silica fine particles except that the particle diameter and BET specific surface area of untreated dry silica to be used were changed, and the strength of the shredding treatment was appropriately adjusted. The physical properties of the silica fine particles A2 to A7 are shown in Table 2.

<Production Example 1 of Silica Fine Particles B>

Silica fine particles B1 were produced by a sol-gel method.

A 3-L glass reactor equipped with a stirring machine, a dropping funnel, and a temperature gauge was loaded with 687.9 g of methanol, 42.0 g of pure water, and 47.1 g of 28 mass % ammonia water, and the contents were mixed. The resultant solution was adjusted to 35° C., and while the solution is stirred, 1,100.0 g (7.23 mol) of tetramethoxysilane and 395.2 g of 5.4 mass % ammonia water were simultaneously added. Tetramethoxysilane and ammonia water were added dropwise over 5 hours and 4 hours, respectively.

Even after the completion of the dropwise addition, stirring was continued for an additional 0.2 hour to perform hydrolysis. Thus, a suspension liquid of hydrophilic spherical sol-gel silica fine particles was obtained.

After that, the pH of the suspension liquid thus prepared was adjusted to about 3.5. After the adjustment, the reactor was heated to 75° C., and while the contents in the reactor were stirred, a solution of 8.8 g of octyltriethoxysilane in 220 mL of isopropyl alcohol was added dropwise. After the dropwise addition, stirring was continued for 5 hours.

After the completion of the stirring, the resultant was cooled to room temperature and filtered. The filtration residue was washed with ion-exchanged water, and then dried by heating at 120° C. overnight. After that, crushing was performed with a pulverizer (manufactured by Hosokawa Micron Corporation) to provide the silica fine particles B1 of interest. It should be noted that the silica fine particles B1 had a number average particle diameter (D1) of primary particle of 114 nm, a half width in a weight-based particle size distribution of 8.7 nm, and a true specific gravity of 2.0 g/mL.

<Production Examples 2 to 6 of Silica Fine Particles B>

Silica fine particles B2 to B6 having different particle size distributions were produced in the same manner as in the production example 1 of the silica fine particles B (see Table 4). It should be noted that the silica fine particles B2 to B6 each had a true specific gravity of 2.0 g/mL.

TABLE 1

| Toner particles | Weight average particle diameter (D4) (μm) | Average circularity |
|---|---|---|
| Toner particles 1 | 8.0 | 0.979 |
| Toner particles 2 | 8.1 | 0.970 |
| Toner particles 3 | 7.9 | 0.962 |
| Toner particles 4 | 8.2 | 0.951 |

TABLE 2

| | Number average particle diameter of primary particles [nm] | Base material BET specific surface area [$m^2/g$] | Treatment number of parts of silicone oil [part(s) by mass] | Treatment number of parts of HMDS [part(s) by mass] | BET specific surface area after surface treatment [$m^2/g$] | Oil fixation ratio [%] | Apparent density (g/L) |
|---|---|---|---|---|---|---|---|
| Silica fine particles A1 | 8 | 300 | 20 | 10 | 135 | 98 | 25 |
| Silica fine particles A2 | 5 | 420 | 32 | 10 | 160 | 98 | 20 |
| Silica fine particles A3 | 20 | 100 | 17 | 10 | 60 | 98 | 40 |
| Silica fine particles A4 | 6 | 380 | 35 | None | 152 | 92 | 52 |
| Silica fine particles A5 | 8 | 300 | 35 | None | 125 | 88 | 50 |
| Silica fine particles A6 | 11 | 200 | 35 | None | 100 | 72 | 55 |
| Silica fine particles A7 | 11 | 200 | 42 | None | 105 | 68 | 60 |

<Production Example of Toner 1>

100 Parts of the toner particles 1 and 0.3 part of the silica fine particles B1 were loaded into a Henschel mixer, and were subjected to first-stage external addition and mixing treatment under premixing conditions and external addition conditions shown in Table 3-1. After that, the treated product was taken out once, and the treated product and 0.9 part of the silica fine particles A1 were subjected to second-stage external addition and mixing treatment with the apparatus illustrated in FIG. 1 under premixing conditions and external addition conditions shown in Table 3-1. Premixing was performed for uniformly mixing the toner particles and the silica fine particles A1. Conditions for the premixing were as follows: the power of the driver section 38 was set to 0.100 W/g (number of revolutions of the driver section 38: 150 rpm) and a treatment time was set to 1 minute. After that, a mixing step (external addition conditions) was performed to provide a particle mixture. A power and an operating time at that time were 0.30 W/g (1,200 rpm) and 5 minutes, respectively.

After the external addition and mixing treatment, a coarse particle and the like were removed with a circular vibrating sieve having placed therein a screen having a diameter of 500 mm and an opening of 75 μm. Thus, a toner was obtained. Its respective physical properties are shown in Table 4.

<Production Examples of Toners 2 to 22 and Comparative Toners 1 to 10>

Toners 2 to 22 and comparative toners 1 to 10 were produced in the same manner as in the production example of the toner 1 except that the kinds and addition numbers of parts of the external additives, the toner particles, the external addition apparatus, the external addition conditions, and the like were changed as shown in Table 3-1 and Table 3-2. External addition conditions for the resultant toners 2 to 22 and comparative toners 1 to 10 are shown in Table 3-1 and Table 3-2. The physical properties of the resultant toners and comparative toners are shown in Table 4.

In each of the production examples, when a Henschel mixer was used as an external addition apparatus, Henschel mixer FM10C (Mitsui Miike Chemical Engineering Machinery, Co., Ltd.) was used.

TABLE 3-1

| | | First-stage external addition conditions | | | | Second-stage external addition conditions | | | |
|---|---|---|---|---|---|---|---|---|---|
| Toner | Toner particles | First-stage external addition apparatus | First-stage premixing conditions | Kind of silica fine particles [addition amount (part(s) by mass)] | First-stage external addition conditions | Second-stage external addition apparatus | Second-stage stage premixing conditions | Kind of silica fine particles [addition amount (part(s) by mass)] | Second-stage external addition conditions |
| Toner 1 | 1 | HM | 500 rpm · 1 min | B1 [0.30] | 4,000 rpm · 6 min | FIG. 1 | 0.10 W/g (150 rpm) · 1 min | A1 [0.90] | 0.30 W/g (1,200 rpm)/5 min |
| Toner 2 | 1 | FIG. 1 | 0.10 W/g (150 rpm) · 1 min | B1 [0.30] | 0.30 W/g (1,200 rpm)/5 min | FIG. 1 | 0.10 W/g (150 rpm) · 1 min | A1 [0.90] | 0.30 W/g (1,200 rpm)/5 min |
| Toner 3 | 1 | HM | 500 rpm · 1 min | B1 [0.30] | 4,000 rpm · 6 min | FIG. 1 | 0.10 W/g (150 rpm) · 1 min | A2 [0.90] | 0.30 W/g (1,200 rpm)/5 min |
| Toner 4 | 1 | HM | 500 rpm · 1 min | B1 [0.30] | 4,000 rpm · 6 min | FIG. 1 | 0.10 W/g (150 rpm) · 1 min | A3 [0.90] | 0.30 W/g (1,200 rpm)/5 min |
| Toner 5 | 1 | HM | 500 rpm · 1 min | B2 [0.30] | 4,000 rpm · 6 min | FIG. 1 | 0.10 W/g (150 rpm) · 1 min | A1 [0.90] | 0.30 W/g (1,200 rpm)/5 min |
| Toner 6 | 1 | HM | 500 rpm · 1 min | B3 [0.30] | 4,000 rpm · 6 min | FIG. 1 | 0.10 W/g (150 rpm) · 1 min | A1 [0.90] | 0.30 W/g (1,200 rpm)/5 min |
| Toner 7 | 1 | HM | 500 rpm · 1 min | B4 [0.30] | 4,000 rpm · 6 min | FIG. 1 | 0.10 W/g (150 rpm) · 1 min | A1 [0.90] | 0.30 W/g (1,200 rpm)/5 min |
| Toner 8 | 1 | HM | 500 rpm · 1 min | B5 [0.30] | 4,000 rpm · 6 min | FIG. 1 | 0.10 W/g (150 rpm) · 1 min | A1 [0.90] | 0.30 W/g (1,200 rpm)/5 min |
| Toner 9 | 1 | HM | 500 rpm · 1 min | B1 [0.30] | 4,000 rpm · 6 min | FIG. 1 | 0.10 W/g (150 rpm) · 1 min | A1 [0.50] | 0.30 W/g (1,200 rpm)/5 min |
| Toner 10 | 1 | HM | 500 rpm · 1 min | B1 [0.30] | 4,000 rpm · 6 min | FIG. 1 | 0.10 W/g (150 rpm) · 1 min | A1 [1.50] | 0.30 W/g (1,200 rpm)/5 min |
| Toner 11 | 1 | HM | 500 rpm · 1 min | B1 [0.30] | 4,000 rpm · 6 min | FIG. 1 | 0.10 W/g (150 rpm) · 1 min | A1 [0.40] | 0.30 W/g (1,200 rpm)/5 min |
| Toner 12 | 1 | HM | 500 rpm · 1 min | B1 [0.30] | 4,000 rpm · 6 min | FIG. 1 | 0.10 W/g (150 rpm) · 1 min | A1 [1.80] | 0.30 W/g (1,200 rpm)/5 min |
| Toner 13 | 1 | HM | 500 rpm · 1 min | B1 [0.10] | 4,000 rpm · 6 min | FIG. 1 | 0.10 W/g (150 rpm) · 1 min | A1 [0.90] | 0.30 W/g (1,200 rpm)/5 min |
| Toner 14 | 1 | HM | 500 rpm · 1 min | B1 [0.50] | 4,000 rpm · 6 min | FIG. 1 | 0.10 W/g (150 rpm) · 1 min | A1 [0.90] | 0.30 W/g (1,200 rpm)/5 min |
| Toner 15 | 1 | HM | 500 rpm · 1 min | B1 [1.00] | 4,000 rpm · 6 min | FIG. 1 | 0.10 W/g (150 rpm) · 1 min | A1 [0.90] | 0.30 W/g (1,200 rpm)/5 min |
| Toner 16 | 1 | HM | 500 rpm · 1 min | B1 [0.30] | 4,000 rpm · 6 min | FIG. 1 | 0.10 W/g (150 rpm) · 1 min | A4 [0.90] | 0.30 W/g (1,200 rpm)/5 min |
| Toner 17 | 1 | HM | 500 rpm · 1 min | B1 [0.30] | 4,000 rpm · 6 min | FIG. 1 | 0.10 W/g (150 rpm) · 1 min | A5 [0.90] | 0.30 W/g (1,200 rpm)/5 min |
| Toner 18 | 1 | HM | 500 rpm · 1 min | B1 [0.30] | 4,000 rpm · 6 min | FIG. 1 | 0.10 W/g (150 rpm) · 1 min | A6 [0.90] | 0.30 W/g (1,200 rpm)/5 min |
| Toner 19 | 1 | HM | 500 rpm · 1 min | B1 [0.30] | 4,000 rpm · 6 min | FIG. 1 | 0.10 W/g (150 rpm) · 1 min | A7 [0.90] | 0.30 W/g (1,200 rpm)/5 min |
| Toner 20 | 2 | HM | 500 rpm · 1 min | B1 [0.30] | 4,000 rpm · 6 min | FIG. 1 | 0.10 W/g (150 rpm) · 1 min | A1 [0.90] | 0.30 W/g (1,200 rpm)/5 min |
| Toner 21 | 3 | HM | 500 rpm · 1 min | B1 [0.30] | 4,000 rpm · 6 min | FIG. 1 | 0.10 W/g (150 rpm) · 1 min | A1 [0.90] | 0.30 W/g (1,200 rpm)/5 min |
| Toner 22 | 4 | HM | 500 rpm · 1 min | B1 [0.30] | 4,000 rpm · 6 min | FIG. 1 | 0.10 W/g (150 rpm) · 1 min | A1 [0.90] | 0.30 W/g (1,200 rpm)/5 min |

External addition apparatus: The term "FIG. 1" means the "apparatus illustrated in FIG. 1" and the term "HM" means the "Henschell mixer."

TABLE 3-2

| | | First-stage external addition conditions | | | | Second-stage external addition conditions | | | |
|---|---|---|---|---|---|---|---|---|---|
| Toner | Toner particles | First-stage external addition apparatus | First-stage premixing conditions | Kind of silica fine particles [addition amount (part(s) by mass)] | First-stage external addition conditions | Second-stage external addition apparatus | Second-stage premixing conditions | Kind of silica fine particles [addition amount (part(s) by mass)] | Second-stage external addition conditions |
| Comparative Toner 1 | 1 | HM | 500 rpm · 1 min | B6 [0.30] | 4,000 rpm · 6 min | FIG. 1 | 0.10 W/g (150 rpm) · 1 min | A1 [0.90] | 0.30 W/g (1,200 rpm)/5 min |

TABLE 3-2-continued

| Toner | Toner particles | First-stage external addition conditions | | | | Second-stage external addition conditions | | | |
|---|---|---|---|---|---|---|---|---|---|
| | | First-stage external addition apparatus | First-stage premixing conditions | Kind of silica fine particles [addition amount (part(s) by mass)] | First-stage external addition conditions | Second-stage external addition apparatus | Second-stage premixing conditions | Kind of silica fine particles [addition amount (part(s) by mass)] | Second-stage external addition conditions |
| Comparative Toner 2 | 1 | FIG. 1 | 0.10 W/g (150 rpm) · 1 min | B6 [0.30] | 0.30 W/g (1,200 rpm)/5 min | FIG. 1 | 0.10 W/g (150 rpm) · 1 min | A1 [0.90] | 0.30 W/g (1,200 rpm)/5 min |
| Comparative Toner 3 | 1 | HM | 500 rpm · 1 min | B6 [0.30] | 4,000 rpm · 6 min | FIG. 1 | 0.10 W/g (150 rpm) · 1 min | A6 [0.90] | 0.30 W/g (1,200 rpm)/5 min |
| Comparative Toner 4 | 3 | HM | 500 rpm · 1 min | B6 [0.30] | 4,000 rpm · 6 min | FIG. 1 | 0.10 W/g (150 rpm) · 1 min | A1 [0.90] | 0.30 W/g (1,200 rpm)/5 min |
| Comparative Toner 5 | 3 | HM | 500 rpm · 1 min | B6 [0.30] | 4,000 rpm · 6 min | FIG. 1 | 0.10 W/g (150 rpm) · 1 min | A6 [0.90] | 0.30 W/g (1,200 rpm)/5 min |
| Comparative Toner 6 | 1 | FIG. 1 | 0.10 W/g (150 rpm) · 1 min | A1 [0.90] B6 [0.30] | 0.30 W/g (1,200 rpm)/5 min | None | None | None | None |
| Comparative Toner 7 | 1 | FIG. 1 | 0.10 W/g (150 rpm) · 1 min | A1 [0.90] | 0.30 W/g (1,200 rpm)/5 min | FIG. 1 | 0.10 W/g (150 rpm) · 1 min | B6 [0.30] | 0.30 W/g (1,200 rpm)/5 min |
| Comparative Toner 8 | 1 | FIG. 1 | 0.10 W/g (150 rpm) · 1 min | B1 [0.30] | 0.30 W/g (1,200 rpm)/5 min | HM | 500 rpm · 1 min | A1 [0.90] | 4,000 rpm · 6 min |
| Comparative Toner 9 | 1 | FIG. 1 | 0.10 W/g (150 rpm) · 1 min | A1 [0.90] B1 [0.30] | 0.30 W/g (1,200 rpm)/5 min | None | None | None | None |
| Comparative Toner 10 | 1 | HM | 500 rpm · 1 min | A1 [0.90] B1 [0.30] | 4,000 rpm · 6 min | None | None | None | None |

External addition apparatus: The term "FIG. 1" means the "apparatus illustrated in FIG. 1" and the term "HM" means the "Henschel mixer."

TABLE 4

| Toner | Toner particles | Weight average particle diameter (D4) (μm) | Average circularity | Adhesion of silica fine particles A in adhesive force-measuring method by using polycarbonate thin film (% by area) | Number average particle diameter of primary particle of silica fine particles A on toner [nm] | Number average particle diameter of primary particle of silica fine particles B on toner [nm] | Half width of a peak of primary particle in weight-based particle size distribution of silica fine particles B [nm] |
|---|---|---|---|---|---|---|---|
| Toner 1 | 1 | 8.0 | 0.979 | 0.1 | 10 | 114 | 8.7 |
| Toner 2 | 1 | 8.0 | 0.979 | 0.1 | 11 | 114 | 8.8 |
| Toner 3 | 1 | 8.0 | 0.979 | 0.1 | 5 | 113 | 8.7 |
| Toner 4 | 1 | 8.0 | 0.979 | 0.1 | 20 | 115 | 8.6 |
| Toner 5 | 1 | 8.0 | 0.979 | 0.1 | 10 | 80 | 12 |
| Toner 6 | 1 | 8.0 | 0.979 | 0.1 | 12 | 200 | 14.5 |
| Toner 7 | 1 | 8.0 | 0.979 | 0.3 | 10 | 86 | 15 |
| Toner 8 | 1 | 8.0 | 0.979 | 0.4 | 10 | 92 | 25 |
| Toner 9 | 1 | 8.0 | 0.979 | 0.1 | 9 | 114 | 8.7 |
| Toner 10 | 1 | 8.0 | 0.979 | 0.3 | 10 | 115 | 8.6 |
| Toner 11 | 1 | 8.0 | 0.979 | 0.1 | 10 | 114 | 8.7 |
| Toner 12 | 1 | 8.0 | 0.979 | 0.4 | 11 | 114 | 8.8 |
| Toner 13 | 1 | 8.0 | 0.979 | 0.2 | 10 | 113 | 8.7 |
| Toner 14 | 1 | 8.0 | 0.979 | 0.2 | 11 | 114 | 8.8 |
| Toner 15 | 1 | 8.0 | 0.979 | 0.3 | 10 | 114 | 8.7 |
| Toner 16 | 1 | 8.0 | 0.979 | 0.4 | 6 | 113 | 8.8 |
| Toner 17 | 1 | 8.0 | 0.979 | 0.5 | 8 | 114 | 8.7 |
| Toner 18 | 1 | 8.0 | 0.979 | 0.5 | 11 | 112 | 8.6 |
| Toner 19 | 1 | 8.0 | 0.979 | 0.5 | 11 | 114 | 8.7 |
| Toner 20 | 2 | 8.1 | 0.970 | 0.4 | 10 | 113 | 8.7 |
| Toner 21 | 3 | 7.9 | 0.962 | 0.5 | 11 | 114 | 8.8 |
| Toner 22 | 4 | 8.2 | 0.951 | 0.5 | 10 | 115 | 8.7 |
| Comparative Toner 1 | 1 | 8.0 | 0.979 | 1.2 | 10 | 99 | 29.3 |
| Comparative Toner 2 | 1 | 8.0 | 0.979 | 1.3 | 11 | 98 | 29.2 |
| Comparative Toner 3 | 1 | 8.0 | 0.979 | 1.9 | 10 | 99 | 29.3 |
| Comparative Toner 4 | 3 | 7.9 | 0.962 | 2.1 | 11 | 97 | 29.1 |
| Comparative Toner 5 | 3 | 7.9 | 0.962 | 3.2 | 10 | 99 | 29.3 |
| Comparative Toner 6 | 1 | 8.0 | 0.979 | 1.8 | 11 | 98 | 29.4 |
| Comparative Toner 7 | 1 | 8.0 | 0.979 | 1.9 | 10 | 99 | 29.1 |
| Comparative Toner 8 | 1 | 8.0 | 0.979 | 1.4 | 11 | 114 | 8.7 |
| Comparative Toner 9 | 1 | 8.0 | 0.979 | 1.5 | 10 | 114 | 8.6 |
| Comparative Toner 10 | 1 | 8.0 | 0.979 | 1.9 | 10 | 115 | 8.7 |

<Production of Developer Carrying Member 1>

Figure 5:
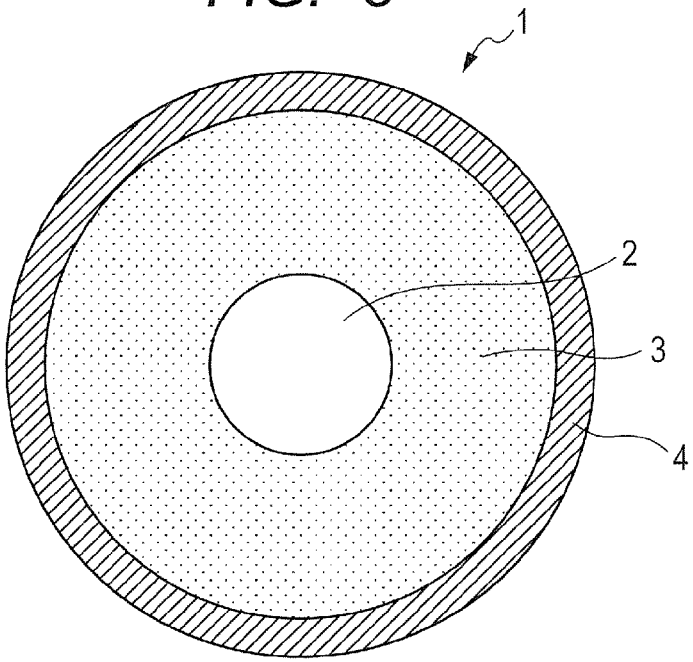
FIG. 5 is a view for illustrating a developer carrying member.

The production of a developer carrying member 1 is described with reference to FIG. 5.

(Synthesis of Isocyanate Group-terminated Prepolymer A-1)

Under a nitrogen atmosphere, in a reaction vessel, 100.0 parts of a polypropylene glycol-based polyol (trade name: EXCENOL 4030; manufactured by Asahi Glass Co., Ltd.) was gradually dropped to 17.7 parts of tolylene diisocyanate (TDI) (trade name: COSMONATE T80; manufactured by Mitsui Chemicals, Inc.) while a temperature in the reaction vessel was held at 65° C. After the completion of the dropping, the mixture was subjected to a reaction at a temperature of 65° C. for 2 hours. The resultant reaction mixture was cooled to room temperature to provide an isocyanate group-terminated prepolymer A-1 having an isocyanate group content of 3.8 mass %.

(Synthesis of Amino Compound (Compound Represented by Structural Formula (1)))

(Synthesis of Amino Compound B-1)

In a reaction vessel mounted with a stirring apparatus, a temperature gauge, a reflux tube, a dropping apparatus, and a temperature-adjusting apparatus, 100.0 parts (1.67 mol) of ethylenediamine and 100 parts of pure water were warmed to 40° C. while being stirred. Next, while the reaction temperature was held at 40° C. or less, 425.3 parts (7.35 mol) of propylene oxide was gradually dropped to the mixture over 30 minutes. The contents were subjected to a reaction by being further stirred for 1 hour. Thus, a reaction mixture was obtained. Water was distilled off by heating the resultant reaction mixture under reduced pressure. Thus, 426 g of an amino compound B-1 was obtained.

Structural formula (1)

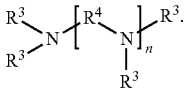

(Preparation of Substrate)

A substrate 2 was prepared by applying and baking a primer (trade name: DY35-051; manufactured by Dow Corning Toray Co., Ltd.) onto a cylindrical tube made of aluminum having an outer diameter of 10 mmϕ (diameter) and an arithmetic average roughness Ra of 0.2 μm, which had been subjected to grinding processing.

(Production of Elastic Roller)

The substrate prepared in the foregoing was placed in a mold, and an addition-type silicone rubber composition obtained by mixing the following materials was injected into a cavity formed in the mold.

| | |
|---|---|
| Liquid silicone rubber material (trade name, SE6724A/B; manufactured by Dow Corning Toray Co., Ltd.) | 100 parts |
| Carbon black (trade name, TOKABLACK #4300; manufactured by Tokai Carbon Co., Ltd.) | 15 parts |
| Silica powder as heat resistance imparting agent | 0.2 part |
| Platinum catalyst | 0.1 part |

Subsequently, the mold was heated, and the silicone rubber was vulcanized at a temperature of 150° C. for 15 minutes to be cured. The substrate having formed on its peripheral surface the cured silicone rubber layer was removed from the mold, and then the substrate was further heated at a temperature of 180° C. for 1 hour, whereby the curing reaction of the silicone rubber layer was completed. Thus, an elastic roller D-2 in which a silicone rubber elastic layer 3 having a thickness of 0.5 mm and a diameter of 11 mm was formed on the outer periphery of the substrate 2 was produced.

(Production of Surface Layer)

617.9 parts of the isocyanate group-terminated prepolymer A-1, 34.2 parts of the amino compound B-1, 117.4 parts of carbon black (trade name, MA230; manufactured by Mitsubishi Chemical Corporation), and 130.4 parts of urethane resin fine particles (trade name, Art-pearl C-400; manufactured by Negami Chemical Industrial Co., Ltd) were mixed through stirring as materials for the surface layer 4.

Next, a paint for forming a surface layer was prepared by adding methyl ethyl ketone (MEK) so that a total solid content ratio became 30 mass %.

Next, the rubber-free portion of the elastic roller D-2 produced in advance was masked. The roller was vertically raised and rotated at 1,500 rpm, and the paint was applied to the roller while a spray gun was lowered at 30 mm/s. Subsequently, the applied layer was cured and dried by being heated in a hot air drying furnace at a temperature of 180° C. for 20 minutes, whereby the surface layer having a thickness of about 8 μm was arranged on the outer periphery of the elastic layer. Thus, the developer carrying member 1 was produced.

Example 1

The following evaluations were performed by using the toner 1 and the developer carrying member 1. The results of the evaluations are shown in Table 5.

(Image-Forming Apparatus)

A reconstructed apparatus of a printer LBP3100 manufactured by Canon Inc. was used in an image output evaluation. With regard to a point of reconstruction, the printer was reconstructed so that the developer carrying member 1 was brought into contact with an electrostatic latent image-bearing member as illustrated in FIG. 3B. It should be noted that an abutment pressure was adjusted so that the width of an abutting portion between the developer carrying member 1 (FIG. 3B: 102) and the electrostatic latent image-bearing member (FIG. 3B: 100) became 1.0 mm. With such reconstruction, a condition under which an evaluation for a developing ghost can be performed in an extremely strict manner is established because no toner-supplying member is present and hence the toner on the developer carrying member cannot be scraped off. Further, a cleaner member (FIG. 3B: 116) configured to recover a transfer residual toner, a fogging toner, paper dust, and the like was removed, and a printing speed was adjusted to be from 16 sheets/min to 24 sheets/min. When the cleaner member is removed as described above, a condition under which an evaluation for melt adhesion to the photosensitive member can be performed in an extremely strict manner is established because the toner, an external additive, and the like that have adhered to the electrostatic latent image-bearing member cannot be scraped off. In addition, when the printing speed is increased, a condition under which the evaluation for the occurrence of the melt adhesion to the photosensitive member can be performed in an additionally strict manner is established because the speed at which a new toner or external additive is brought into contact with a melt adhesion product, such as the toner or the external additive, adhering to the photosensitive member increases, and hence the melt adhesion product is liable to grow. A developing apparatus was produced by using 65 g of the toner of the present invention and the developer carrying member 1 in the developing apparatus reconstructed as described above, and various evaluations were performed. Details about the evaluations are described below.

An evaluation method for each evaluation performed in Examples and Comparative Examples of the present invention and evaluation criteria therefor are described below.

<Image Density>

For an image density, a solid image portion was formed and the density of the solid image was measured with a Macbeth reflection densitometer (manufactured by Macbeth). Evaluation criteria for the reflection density of a solid black image on the first sheet at the initial stage of endurance use are as follows.

A: Extremely excellent (1.46 or more)
B: Excellent (1.41 or more to 1.45 or less)
C: Satisfactory (1.36 or more to 1.40 or less)
D: Poor (1.35 or less)

The criteria of a judgement on an image density after the 2,000-sheet endurance use are also as described above.

A smaller difference between the reflection density of the solid black image at the initial stage of the endurance use and the reflection density of the solid black image after the 2,000-sheet endurance use was judged to be better.

A: Extremely excellent (difference of less than 0.06)
B: Excellent (difference of 0.06 or more and less than 0.12)
C: Satisfactory (difference of 0.12 or more and less than 0.17)
D: Poor (difference of 0.17 or more)

[Developing Ghost]

An image was output on 2,000 sheets in a low-temperature and low-humidity environment (temperature: 15° C./relative humidity: 10% RH). It should be noted that the image output test was performed by outputting, as the image, such an image that horizontal lines were drawn at a print percentage of 1% according to an intermittent mode. A plurality of solid images each measuring 10 mm by 10 mm were formed on the upper half of transfer paper, and a 2-dot and 3-space halftone image was formed on the lower half thereof. The extent to which the traces of the solid images appeared on the halftone image was visually judged. The criteria of judgments on the ghosts of the solid black images on a first sheet at the initial stage of endurance use and after the 2,000-sheet endurance use are as described below.

A: No ghost occurs.
B: A ghost occurs in an extremely slight manner.
C: A ghost slightly occurs.
D: A ghost remarkably occurs.

[Melt Adhesion to Photosensitive Member]

An image was output on 2,000 sheets in a high-temperature and high-humidity environment (32.5° C./relative humidity: 80% RH). It should be noted that the image output test was performed by outputting, as the image, such an image that horizontal lines were drawn at a print percentage of 1% according to a continuous mode. The melt adhesion to the photosensitive member was judged by outputting a solid black image during the 2,000-sheet endurance test. The criteria of a judgment on the melt adhesion to the photosensitive member are as described below.

A: During the endurance, even when the photosensitive member is observed, no trace of the melt adhesion to the photosensitive member is observed.
B: During the endurance, the melt adhesion to the photosensitive member can be slightly observed, but does not appear as a white spot image on the solid black image.
C: During the endurance, a white spot image corresponding to the period of the photosensitive member, the image accompanying the melt adhesion to the photosensitive member, is slightly observed in the solid black image.
D: During the endurance, a white spot image corresponding to the period of the photosensitive member, the image accompanying the melt adhesion to the photosensitive member, is conspicuous in the solid black image.

Examples 2 to 22 and Comparative Examples 1 to 10

Toner evaluations were performed by using the toners 2 to 22 and the comparative toners 1 to 10 as toners under the same conditions as those of Example 1. The results of the evaluations are shown in Table 5.

TABLE 5

| | | Image density | | Developing ghost rank | | Rank of melt adhesion to |
|---|---|---|---|---|---|---|
| | | Initial stage | After 2,000-sheet endurance use | Initial stage | After 2,000-sheet endurance use | photosensitive member |
| Example 1 | Toner 1 | A (1.52) | A (0.02) | A | A | A |
| Example 2 | Toner 2 | A (1.53) | A (0.02) | A | A | A |
| Example 3 | Toner 3 | A (1.50) | A (0.04) | A | A | A |
| Example 4 | Toner 4 | A (1.49) | A (0.03) | A | A | A |
| Example 5 | Toner 5 | A (1.52) | A (0.03) | A | A | A |
| Example 6 | Toner 6 | A (1.48) | A (0.03) | A | A | A |
| Example 7 | Toner 7 | A (1.50) | A (0.03) | A | A | A |
| Example 8 | Toner 8 | A (1.47) | A (0.05) | A | B | A |
| Example 9 | Toner 9 | A (1.51) | A (0.04) | A | A | A |
| Example 10 | Toner 10 | A (1.51) | A (0.02) | A | A | A |
| Example 11 | Toner 11 | B (1.45) | B (0.07) | A | B | A |
| Example 12 | Toner 12 | A (1.50) | A (0.03) | A | B | A |
| Example 13 | Toner 13 | A (1.49) | A (0.05) | A | A | A |
| Example 14 | Toner 14 | A (1.51) | A (0.03) | A | A | A |
| Example 15 | Toner 15 | A (1.49) | A (0.03) | A | B | A |
| Example 16 | Toner 16 | A (1.50) | A (0.04) | A | A | A |
| Example 17 | Toner 17 | A (1.48) | B (0.07) | A | B | B |
| Example 18 | Toner 18 | A (1.46) | B (0.10) | A | B | B |
| Example 19 | Toner 19 | B (1.43) | C (0.13) | B | C | C |
| Example 20 | Toner 20 | A (1.48) | A (0.05) | A | A | A |
| Example 21 | Toner 21 | B (1.44) | B (0.08) | B | B | C |
| Example 22 | Toner 22 | B (1.42) | C (0.12) | B | C | C |

TABLE 5-continued

| | | Image density | | Developing ghost rank | | Rank of melt adhesion to |
|---|---|---|---|---|---|---|
| | | Initial stage | After 2,000-sheet endurance use | Initial stage | After 2,000-sheet endurance use | photosensitive member |
| Comparative Example 1 | Comparative toner 1 | B (1.45) | C (0.15) | C | D | D |
| Comparative Example 2 | Comparative toner 2 | B (1.44) | C (0.16) | C | D | D |
| Comparative Example 3 | Comparative toner 3 | C (1.39) | D (0.19) | C | D | D |
| Comparative Example 4 | Comparative toner 4 | C (1.38) | D (0.20) | C | D | D |
| Comparative Example 5 | Comparative toner 5 | D (1.34) | D (0.25) | D | D | D |
| Comparative Example 6 | Comparative toner 6 | C (1.38) | D (0.18) | C | D | D |
| Comparative Example 7 | Comparative toner 7 | C (1.37) | D (0.19) | C | D | D |
| Comparative Example 8 | Comparative toner 8 | D (1.34) | D (0.21) | D | D | D |
| Comparative Example 9 | Comparative toner 9 | C (1.36) | D (0.20) | C | D | D |
| Comparative Example 10 | Comparative toner 10 | D (1.32) | D (0.22) | D | D | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-241180, filed Nov. 28, 2014 and Japanese Patent Application No. 2015-219304, filed Nov. 9, 2015, which are hereby incorporated by reference herein in their entirety.

What is claimed is:

1. A toner, comprising:

a toner particle containing a binder resin and a colorant; and a silica fine particle comprising a silica fine particle A having a number average particle diameter (D1) of primary particle of 5 to 20 nm, and a silica fine particle B having a number average particle diameter (D1) of primary particle of 80 to 200 nm, wherein the silica fine particle B has a half width of a peak of primary particle of 25 nm or less, in a weight-based particle size distribution, and an adhesion of the silica fine particle A is 0.5% by area or less relative to 100% by area of the total area of a polycarbonate thin film when the toner is measured by an adhesive force-measuring method by using the polycarbonate thin film.

2. A toner according to claim 1, wherein the toner particle has an average circularity of 0.960 or more.

3. A toner according to claim 1, wherein an amount of the silica fine particle A is 0.5 to 1.5 parts by mass with respect to 100 parts by mass of the toner particle.

4. A toner according to claim 1, wherein an amount of the silica fine particle B is 0.1 to 1.0 part by mass with respect to 100 parts by mass of the toner particle.

5. A toner according to claim 1, wherein the silica fine particle A is subjected to surface treatment with 5.0 to 40.0 parts by mass of a silicone oil with respect to 100 parts by mass of a base material silica, and has a carbon amount-based fixation ratio (%) of the silicone oil of 70% or more.

6. A toner according to claim 1, wherein the silica fine particle A has an apparent density of 15 to 50 g/L or less.

7. A toner according to claim 1, wherein the silica fine particle A is obtained by treating a base material silica with a silicone oil, and then treating the base material silica with at least one of an alkoxysilane or a silazane.

8. A toner according to claim 1, wherein the silica fine particle B has the half width of a peak of primary particle of 15 nm or less, in the weight-based particle size distribution.

9. A method of producing a toner, the method comprising:

a step 1 of externally adding a silica fine particle B having a number average particle diameter (D1) of primary particle of 80 to 200 nm to a toner particle containing a binder resin and a colorant, the silica fine particle B having a half width of a peak of primary particle of 25 nm or less, in a weight-based particle size distribution; and a step 2 of externally adding a silica fine particle A having a number average particle diameter (D1) of primary particle of 5 to 20 nm, to a toner, the step 2 comprising a step of loading the product obtained in the step 1 and the silica fine particle A into a container of a mixing treatment apparatus, followed by treatment, the mixing treatment apparatus comprising a stirring member including a rotary shaft and a plurality of stirring blades arranged on a surface of the rotary shaft, a container having a cylindrical inner peripheral surface in which the stirring member is stored, and a driver section configured to apply a rotary driving force to the rotary shaft to rotate the stirring member in the container, the plurality of stirring blades being each arranged to have a gap between the stirring blade and the inner peripheral surface of the container, the plurality of stirring blades including a first stirring blade configured to feed a mixing-treated product loaded into the container toward one orientation in an axial direction of the rotary shaft through rotation of the stirring member, and a second stirring blade configured to feed the mixing-treated product toward another orientation in the axial direction of the rotary shaft through the rotation.

10. A method of producing a toner according to claim 9, wherein the silica fine particle A is obtained by treating a base material silica with a silicone oil, and then treating the base material silica with at least one of an alkoxysilane or a silazane.

11. A method of producing a toner according to claim 9, wherein an adhesion of the silica fine particle A is 0.5% by area or less relative to 100% by area of the total area of a polycarbonate thin film when the toner is measured by an adhesive force-measuring method by using the polycarbonate thin film.

* * * * *